US010648756B2

(12) United States Patent
Mooty

(10) Patent No.: US 10,648,756 B2
(45) Date of Patent: May 12, 2020

(54) SUPPRESSOR ASSEMBLY

(71) Applicant: Sig Sauer, Inc., Newington, NH (US)

(72) Inventor: Thomas Mooty, Manchester, NH (US)

(73) Assignee: SIG SAUER, INC, Newington, NH (US)

( * ) Notice: Subject to any disclaimer, the term of this patent is extended or adjusted under 35 U.S.C. 154(b) by 0 days.

(21) Appl. No.: 15/986,878

(22) Filed: May 23, 2018

(65) Prior Publication Data

US 2018/0340750 A1 Nov. 29, 2018

Related U.S. Application Data

(60) Provisional application No. 62/510,475, filed on May 24, 2017.

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/30; F41A 21/34
USPC ..... 89/14.4
See application file for complete search history.

(56) References Cited

U.S. PATENT DOCUMENTS

| | | | |
|---|---|---|---|
| 1,000,702 A | 8/1911 | Thurler | |
| 1,341,363 A | 5/1920 | Fiala | |
| 2,468,926 A | 12/1944 | Garrett | |
| 3,385,164 A | 5/1968 | Walther et al. | |
| 4,291,610 A | 9/1981 | Waiser | |
| 4,454,798 A | 6/1984 | Shea et al. | |
| 4,588,043 A | 5/1986 | Finn | |
| 4,974,489 A | 12/1990 | Fishbaugh | |
| 5,029,512 A | 7/1991 | Latka | |
| 5,136,924 A | 8/1992 | Foerster et al. | |
| 5,425,299 A | 6/1995 | Teetzel | |
| 6,308,609 B1 | 10/2001 | Davies | |
| 6,374,718 B1 | 4/2002 | Rescigno et al. | |
| 6,575,074 B1 | 6/2003 | Gaddini | |
| 8,167,084 B1 * | 5/2012 | Moore | F41A 21/30 181/223 |

(Continued)

FOREIGN PATENT DOCUMENTS

| | | |
|---|---|---|
| EP | 1764577 | 3/2007 |
| WO | 2015016998 | 2/2015 |

OTHER PUBLICATIONS

Operators Suppressor Systems Info Sheet 2015, 1 page.

*Primary Examiner* — Joshua E Freeman
(74) *Attorney, Agent, or Firm* — Finch & Maloney PLLC

(57) ABSTRACT

A suppressor assembly for a firearm includes a diffusor assembly with a body extending along a central axis. At least one diffusor baffle extends across an inside of the body in a direction transverse to the central axis. The diffusor baffle defines a diffusor central opening and a plurality of outer diffusor openings positioned radially outside the diffusor central opening. Signature-reduction baffles include a first baffle portion that extends across the inside of the body and that defines a central baffle opening and a baffle port positioned radially outside of the central baffle opening. A second baffle portion is connected to the first baffle portion opposite the baffle port and radially outside of the central baffle opening. The second baffle portion extends at an angle to the body sidewall.

24 Claims, 16 Drawing Sheets

(56) References Cited

U.S. PATENT DOCUMENTS

| | | | | |
|---|---|---|---|---|
| 8,196,701 | B1 | 6/2012 | Oliver | |
| 8,286,750 | B1 | 10/2012 | Oliver | |
| 8,490,535 | B1 * | 7/2013 | Moore | F41A 21/30 89/14.2 |
| 8,516,941 | B1 | 8/2013 | Oliver | |
| 8,522,662 | B2 | 9/2013 | Presz, Jr. et al. | |
| 8,579,075 | B2 | 11/2013 | Brittingham et al. | |
| 8,671,818 | B1 | 3/2014 | Oliver | |
| 8,790,434 | B1 | 7/2014 | Oliver | |
| 8,826,793 | B2 | 9/2014 | Oliver | |
| 9,052,152 | B2 | 6/2015 | Moss et al. | |
| 9,175,920 | B2 | 11/2015 | Moore | |
| 9,316,456 | B1 | 4/2016 | Oliver | |
| 9,347,727 | B1 | 5/2016 | Cler | |
| 9,423,198 | B1 | 8/2016 | Oliver | |
| 9,435,600 | B2 | 9/2016 | Oliver | |
| 9,835,399 | B1 | 12/2017 | Lessard | |
| 10,024,617 | B1 * | 7/2018 | Moore | F41A 21/30 |
| 2007/0107590 | A1 | 5/2007 | Silvers | |
| 2009/0200105 | A1 | 8/2009 | Geyer, III | |
| 2010/0163336 | A1 * | 7/2010 | Presz, Jr. | F41A 13/08 181/223 |
| 2011/0067950 | A1 | 3/2011 | Shults et al. | |
| 2012/0272818 | A1 * | 11/2012 | Dueck | F41A 21/30 89/14.4 |
| 2014/0035076 | A1 | 2/2014 | Zhang et al. | |
| 2014/0262605 | A1 | 9/2014 | Washburn, III et al. | |
| 2014/0360807 | A1 | 12/2014 | McKenzie | |
| 2015/0136519 | A1 * | 5/2015 | Moore | F41A 21/44 181/223 |
| 2015/0260472 | A1 | 9/2015 | Smith | |
| 2016/0084602 | A1 | 3/2016 | Smith | |
| 2016/0109205 | A1 | 4/2016 | Coppinger et al. | |
| 2016/0238335 | A1 | 8/2016 | Bertschinger et al. | |
| 2017/0321984 | A1 * | 11/2017 | Palu | F41A 21/34 |

* cited by examiner

SUPPRESSOR ASSEMBLY

RELATED APPLICATIONS

This application claims priority under 35 U.S.C. § 119(e) to US Provisional Patent Application No. 62/510,475 titled SUPPRESSOR, and filed on May 24, 2017, the contents of which are incorporated herein by reference in its entirety.

FIELD OF THIS DISCLOSURE

This disclosure relates to accessories for use with firearms and more particularly to a suppressor for use with a firearm.

BACKGROUND

Firearms design involves many non-trivial challenges. In particular, firearms, such as small arms and handguns, have faced particular complications with reducing the audible and visible signature while also maintaining the desired ballistic performance.

Some accessories are designed to be mounted to the muzzle-end of a firearm barrel in one or more particular rotational orientations to accomplish a desired effect. For example, a muzzle brake redirects a portion of propellant gases sideways or rearward, with respect to the firing direction, as the gases escape from the barrel when a shot is fired. As the gases are redirected, the firearm is pushed forward in a manner that counteracts recoil of the firearm. A muzzle brake is typically mounted to a firearm barrel in a particular rotational orientation, such as to prevent gases from being redirected upward into the line of sight of the firearm operator. The manner of rotationally orienting a muzzle end accessory on the barrel is often referred to as timing the accessory to the barrel.

Suppressors are another muzzle-end mounted accessory intended to reduce the audible report of the firearm. Suppressors may include a series of baffled chambers to slow the release of pressurized gases from the barrel of the firearm and therefore reduce the audible report when discharging the firearm. The United States Bureau of Alcohol, Tobacco, Firearms, and Explosives currently defines a suppressor as any device that, when attached to the muzzle of a firearm, reduces the audible report of the firearm by a perceptible amount.

SUMMARY

Aspects of the present disclosure include a suppressor assembly and components thereof. In accordance with one embodiment of the present disclosure, a suppressor assembly includes a suppressor and a diffusor assembly, where the diffusor assembly includes a diffusor portion and a signature-reduction portion located distally of the diffusor portion. In one embodiment, the suppressor includes a cylindrical volume which shields the operator from some of the discomfort associated with the sound, concussion, flash, and heat of the muzzle blast that is a natural result of launching a projectile using combustible propellant. The proximal end portion of the suppressor has a barrel mount configured to attach to the muzzle of the host firearm with the central axis aligned with the bore axis of the host firearm. The distal end portion of the suppressor is configured to mount a diffusor assembly to further reduce the signature of the firearm, including flash and sound. In one embodiment, a diffusor assembly has an annular diffusor body extending distally and expanding radially along the central axis. At least one diffusor portion extends across the diffusor body generally perpendicular to the central axis. Each diffusor portion defines a diffusor central opening axially aligned with the bore of the barrel on the central axis, and a plurality of outer diffusor openings distributed circumferentially about the diffusor central opening. The diffusor assembly also includes a plurality of signature-reduction baffles each having a baffle portion extending across the inside of the diffusor body. For example, the baffle portion extends generally perpendicular to the central axis. The baffle portion of each signature-reduction baffle defines a central baffle opening aligned with the bore of the muzzle and a generally crescent-shaped baffle port positioned radially outside of the central baffle opening. The suppressor assembly may include a distal cap attached to a distal end of the diffusor assembly and defines a distal cap central opening aligned with the bore of the barrel.

In another embodiment, the baffle port of each baffle is rotated out of alignment with respect to the baffle port of an adjacent baffle, thereby defining an elongated and less restrictive flow path through the suppressor portion. In one such embodiment, the baffle port of each baffle is rotated about the central axis 180 to 225 degrees with respect to the baffle port of an adjacent baffle, where the elongated and less restrictive flow path is sinuous and rotates about the central axis along the suppressor portion as the flow moves axially through the signature reduction baffles. In yet other embodiments, the baffle port of each baffle is rotated about the central axis from 185 to 225 degrees with respect to the baffle port of an adjacent baffle, including from 185 to 215 degrees and from 185 to 200 degrees.

In another embodiment, the central baffle opening extends through the baffle portion of the baffle at a baffle bore angle from 30 to 60 degrees with respect to the central axis, where the central baffle opening provides an axial through-opening at least as large as the bore of the barrel.

In another embodiment, each of the baffles defines one or more flow-directing features. One such flow-directing feature is a sloped baffle surface extending between and connecting the baffle and the hollow wall, where the sloped baffle surface extends at an angle from 30° to 60° with respect to a proximal face of the baffle. Another flow-directing feature is a flat or concavely-beveled entrance surface on a proximal face of the baffle adjacent the central baffle opening. Another flow-directing feature is a flat or concavely-beveled exit surface on a distal face of the baffle adjacent the central baffle opening. Yet another flow-directing feature is a protrusion extending distally from a proximal face of the baffle adjacent the central baffle opening, where propellant gases passing along the proximal face in a direction generally perpendicular to the central axis are directed away from the central baffle opening.

In another embodiment, the first diffusor central opening is larger than the second diffusor central opening, and the second diffusor central opening is equal to or larger than the central baffle opening of each of the signature-reduction baffles.

In another embodiment, the diffusor assembly provides a first flow path and a second flow path for propellant gases. The first flow path generally follows the central axis and the second flow path generally follows an elongated and less restrictive path through the baffle port of each of the signature-reduction baffles. In one embodiment, propellant gases following the first flow path mix with propellant gasses following the second flow path at a location offset from the central axis.

In another embodiment, the diffusor assembly provides a combination of flash suppression and sound suppression.

In another embodiment, the diffusor portion of the diffusor assembly includes a first diffusor portion and a second diffusor portion. The first diffusor portion includes a first diffusor baffle extending across the diffusor body generally perpendicular to the central axis, where the first diffusor baffle defines a first diffusor central opening axially aligned with the bore of the barrel on the central axis, and a plurality of first diffusor outer openings distributed circumferentially about the first diffusor central opening. The second diffusor portion includes a second diffusor baffle with a diffusor hub oriented generally perpendicular to the diffusor body and defining a second diffusor central opening axially aligned with the bore of the barrel. Spokes extend radially from the diffusor hub to the diffusor body and define a plurality of second diffusor outer openings. In one embodiment, each of the first diffusor outer openings is rotated out of alignment with the second diffusor outer openings.

In another embodiment, the suppressor assembly provides a first flow path and an elongated and less restrictive second flow path for propellant gases resulting from discharge of the firearm. The first flow path generally follows the central axis and the second flow path follows an elongated and less restrictive path through the baffle ports of the baffles. In one embodiment, propellant gases following the first flow path mix with propellant gasses following the second flow path at every location where the first portion of gases shares a volume with the second portion of the gases.

In another embodiment, the diffusor assembly is releasably attached to the suppressor. For example, the diffusor assembly is threadably attached to the suppressor with a mating tapered surface to lock the two parts together and to prevent leakage of high pressure gases.

In another embodiment, the diffusor includes a first diffusor portion and a second diffusor portion. The first diffusor portion defines a plurality first outer diffusor openings and the second diffusor portion defines a plurality of second outer diffusor openings. In one embodiment, the first outer diffusor openings are rotated out of alignment with the second outer diffusor openings. For example, when the first diffusor portion includes four first outer diffusor openings and the second diffusor portion has four second outer diffusor openings, the first diffusor portion is rotated by about 45 degrees with respect to the second diffusor portion.

In accordance with another embodiment of this disclosure, an embodiment of the suppressor assembly is attached to the muzzle of a firearm. For example, the firearm is a pistol, a rifle, a machine gun, or an autocannon.

Another aspect of the present disclosure is directed to a signature-reduction assembly for use with a firearm. In one embodiment, the signature-reduction assembly includes a body with a tubular sidewall extending along a central axis between a proximal end and a distal end, the body including a diffusor portion adjacent the proximal end and a signature-reduction portion adjacent the distal end. The diffusor portion of the body has one or more diffusor baffles extending across an inside of the tubular sidewall in a direction transverse to the central axis, where each diffusor baffle defines a central diffusor opening aligned with the central axis and a plurality of outer diffusor openings positioned radially outside of the central diffusor opening. The signature-reduction portion is located distally of the one or more diffusor baffles has a plurality of signature-reduction baffles extending across an inside of the tubular sidewall in a direction transverse to the central axis. Each signature-reduction baffle defines a central baffle opening aligned with the central axis and a baffle port positioned radially outside of the central baffle opening. The baffle port of each of the plurality of signature-reduction baffles is rotated about the central axis from 185 to 225 degrees with respect to the baffle port of an adjacent one of the plurality of signature-reduction baffles. The signature-reduction assembly provides a first gas flow path generally along the central axis, and an elongated and less restrictive second gas flow path through the baffle ports of the signature-reduction baffles.

In some embodiments, the diffusor assembly provides a combination of flash suppression and sound suppression in a single monolithic unit.

In some embodiments, propellant gases following the first gas flow path mix with propellant gasses following the elongated and less restrictive second gas flow path between adjacent signature-reduction baffles.

In some embodiments, the elongated and less restrictive second gas flow path is a rotating, sinuous flow path through the baffle ports of the signature-reduction baffles.

In some embodiments, one of more of the signature-reduction baffles has a first baffle portion that defines the central baffle opening and the baffle port. A second baffle portion is positioned opposite the baffle port and extends at an angle from the first baffle portion to the tubular sidewall.

In some embodiments, the signature-reduction baffles have a beveled entrance surface adjacent the central baffle opening and/or a beveled exit surface adjacent the central baffle opening. In one embodiment, the central baffle opening extends through the signature-reduction baffle at a baffle bore angle from 30 to 60 degrees with respect to the central axis.

In some embodiments, one of more of the signature-reduction baffles has a protrusion extending from a proximal face of the signature-reduction baffle. For example, the protrusion at least partially surrounds the central baffle opening and is configured to direct propellant gases away from the central baffle opening.

In some embodiments, an area of the plurality of outer diffusor openings is at least three times an area of the central diffusor opening. In other embodiments, the combined area of the outer diffusor openings is at least five times, at least ten times, or at least fifteen times the area of the central diffusor opening.

In some embodiments, the signature-reduction assembly includes a suppressor attached to the signature-reduction assembly, the suppressor having a barrel mount and a hollow suppressor body. The suppressor can be configured to couple the signature-reduction assembly to a barrel of a host firearm with the central axis of the signature-reduction assembly aligned with a bore axis of the barrel. For example, the suppressor is removably attachable to the signature-reduction assembly.

Another aspect of the present disclosure is directed to a diffusor assembly configured for use with a host firearm having a barrel with a bore extending therethrough along a bore axis. In one embodiment, the diffusor assembly includes a body with a tubular sidewall extending along a central axis. At least one diffusor baffle extends across an inside of the tubular sidewall in a direction transverse to the central axis, where the diffusor baffle defines a diffusor central opening aligned with the central axis and a plurality of outer diffusor openings positioned between the diffusor central opening and the tubular diffusor body. A plurality of signature-reduction baffles is located distally of the at least one diffusor baffle. Each signature-reduction baffle extends across the inside of the tubular sidewall in a direction transverse to the central axis. Each signature-reduction baffle has a first baffle portion extending generally perpendicularly to the central axis. The first baffle portion defines a central baffle opening aligned with the central axis, and a baffle port positioned radially outside of the central baffle opening. A second baffle portion is directly connected to the first baffle portion and defines an angle from 10 to 60 degrees with the first baffle portion as it extends proximally from the first baffle portion to the tubular sidewall. The second baffle portion is positioned opposite the baffle port and radially outside of the central baffle opening.

In some embodiments, a sum of areas of the plurality of outer diffusor openings is at least three times an area of the diffusor central opening and the baffle port has an area that is at least three times an area of the central baffle opening.

In some embodiments, one of more of the plurality of signature-reduction baffles has a beveled entrance surface and/or a beveled exit surface adjacent the central baffle opening.

In some embodiments, one of more of the signature-reduction baffles has a protrusion on a proximal face of the first baffle portion, where the protrusion at least partially surrounds the central baffle opening and is configured to direct propellant gases away from the central baffle opening.

In some embodiments, a suppressor is attached or is configured to be attached to a proximal end portion of the diffusor assembly. The suppressor has a suppressor proximal end portion with a barrel mount attachable to the barrel of the host firearm. In some embodiments, a distal end portion of the suppressor is configured to removably attach the diffusor assembly. For example, in one embodiment, the suppressor is threadably connected to the diffusor assembly, where the threaded connection is sealed and frictionally retained in the assembled position due to a surface with a sealing taper that has an included angle between 25° and 60°.

In some embodiments, a firearm barrel is attached to the suppressor via the barrel mount and the suppressor is attached to the diffusor assembly. Discharging the firearm releases propellant gases from the barrel into the suppressor, where a minority portion of the propellant gases follows a first flow path generally along the central axis through the diffusor assembly and a majority portion of the propellant gases follow a second flow path through the outer diffusor openings and the baffle port of each of the plurality of signature-reduction baffles.

Another aspect of the present disclosure is directed to a suppressor baffle. In one embodiment, the suppressor baffle has a tubular body extending along a central axis between a first end and a second end. A baffle is connected to the body and extends across an inside of the body in a direction transverse to the central axis. The baffle has a first baffle portion defining a central baffle opening aligned with the central axis and a baffle port positioned radially between the central baffle opening and the tubular body. For example, the first baffle portion extends generally perpendicularly to the central axis. A second baffle portion is connected to the first baffle portion radially outside of the central baffle opening and positioned opposite the baffle port. The second baffle portion defines an angle from 10 to 60 degrees with the first baffle portion and extends proximally from the first baffle portion to the tubular sidewall. An area of the baffle port is at least three times an area of the central baffle opening.

In some embodiments, the central baffle opening extends through the first baffle portion at a baffle bore angle from 30 to 60 degrees with respect to the central axis.

In some embodiments, the suppressor baffle has a beveled surface adjacent the central baffle opening.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
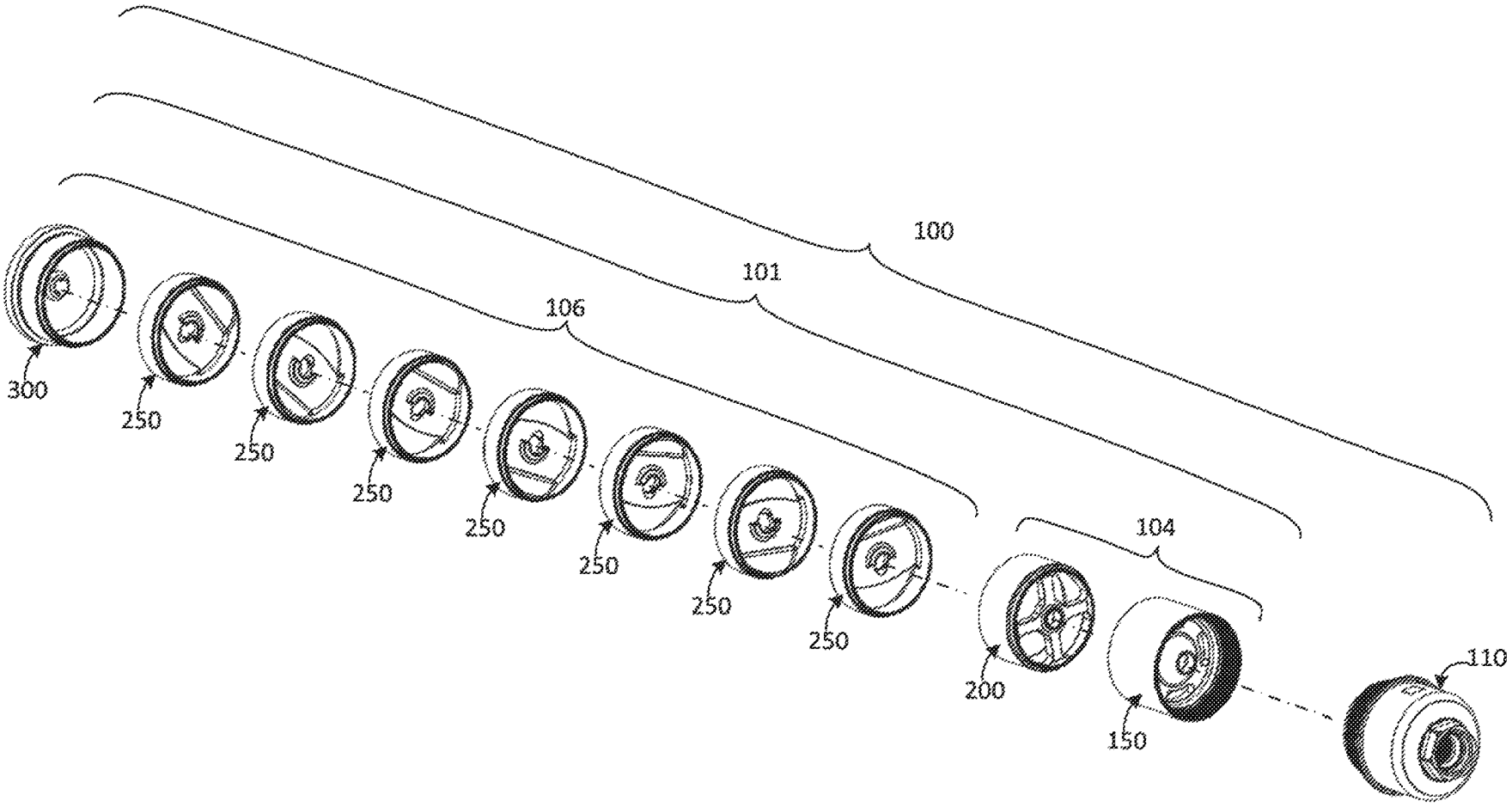
FIG. 1 illustrates an exploded, isometric view of a suppressor assembly in accordance with an embodiment of the present disclosure.

These and other features of the present embodiments will be better understood by reading the following detailed description, taken together with the Figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

A suppressor assembly for a firearm is disclosed. In accordance with some embodiments, the disclosed suppressor assembly includes a suppressor attachable to firearm barrel, and a diffusor assembly that can be attached to the suppressor distal end portion. The suppressor assembly has a generally hollow body with a solid-walled tubular shape extending along a central axis from a proximal end to a distal end, where the central axis corresponds to a path of a projectile fired from the muzzle of a host firearm. The hollow body may be cylindrical and defines a body opening extending along the central axis. The hollow body may comprise a plurality of sections or components as discussed in more detail below. The suppressor includes provisions on the distal end to mount an additional diffusor body. The diffusor body can further reduce one or more aspect of the weapon signature, such as sound, flash, backpressure, and/or heat. The diffusor assembly includes a diffusor portion and a signature-reduction portion, each of which can provide a plurality of flow paths for propellant gases.

In place of a separate diffuser on the weapon's muzzle, embodiments of the suppressor assembly combine a flow diffusor and signature-reduction baffles in a single unit that may be coupled to the muzzle. Embodiments of the suppressor assembly provide a less restrictive elongated and less restrictive flow path around the diffusor baffles, which may be augmented by flow-directing features at the central baffle opening and the signature-reduction portion. The flow-directing feature(s) turn and mix a first portion of expanding propellant passing gases passing generally along the central axis with a second portion of propellant gases following an elongated and less restrictive path through baffle ports of the signature-reduction baffles. Numerous configurations and variations will be apparent in light of this disclosure.

General Overview

As noted above, non-trivial issues may arise that complicate weapons design and performance of firearms. For instance, one non-trivial issue pertains to the fact that the discharge of a firearm normally produces an audible report resulting from rapidly expanding propellant gases and from the projectile leaving the muzzle at a velocity greater than the speed of sound. It is generally understood that attenuating the audible report may be accomplished by slowing the rate of expansion of the propellant gases. One possible approach to sound suppression is to attach a small flow diffusor to the muzzle of the host firearm. A separate sound suppressor may then be installed over the flow diffusor. Such a configuration necessarily requires that the flow diffusor be small and inefficient.

In accordance with some embodiments of the present disclosure, a suppressor assembly configured as described herein may include a diffusor assembly with a diffusor portion and a signature-reduction portion in a single unit, where the diffusor assembly can be attached to a suppressor configured to be attached to the muzzle of a host firearm. As will be appreciated in light of this disclosure, and in accordance with some embodiments, a suppressor assembly configured as described herein can be utilized with any of a wide range of firearms, such as, but not limited to, a pistol, a rifle, a machine gun, or an autocannon. In accordance with some example embodiments, a suppressor configured as described herein can be utilized with firearms chambered for ammunition sized from .17 HMR rounds to 30 mm autocannon rounds. In some example cases, the disclosed suppressor is configured to be utilized with a rifle chambered, for example, for 5.56×45 mm NATO rounds or 7.62×51 mm rounds, such as the SIG MCX™, SIG516™, SIG556™ SIGM400™, or SIG 716™ rifles produced by Sig Sauer, Inc. Other suitable host firearms and projectile calibers will be apparent in light of this disclosure.

In accordance with some embodiments, the disclosed apparatus may be detected, for example, by visual inspection of a suppressor assembly having features such as diffusor assembly that has diffusor portion and a signature-reduction portion in a single unit. In accordance with some embodiments, the disclosed apparatus may be detected by a diffusor assembly that has a secondary elongated and less restrictive flow path through baffle ports, baffles with flow-directing features, and/or adjacent baffle ports that are rotated out of alignment with each other. Also, it should be noted that, while generally referred to herein as a 'suppressor assembly' for consistency and ease of understanding the present disclosure, the disclosed suppressor assembly is not limited to that specific terminology and alternatively can be referred to, for example, as a suppressor, a silencer, flash suppressor, or other terms. As will be further appreciated, the particular configuration (e.g., materials, dimensions, etc.) of a suppressor assembly configured as described herein may be varied, for example, depending on whether the target application or end-use is military, tactical, or civilian in nature. Numerous configurations will be apparent in light of this disclosure.

Structure and Operation

Figure 2:
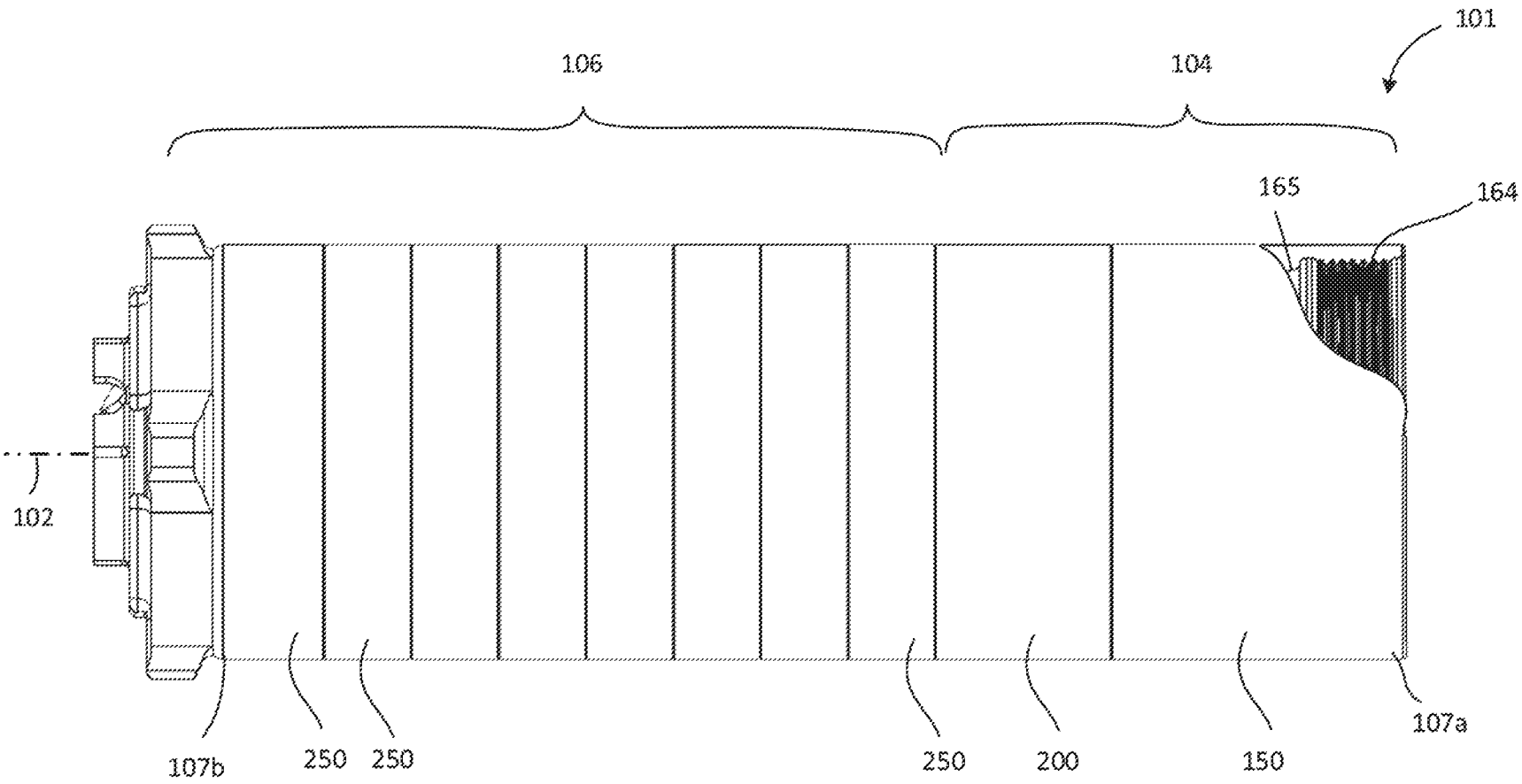
FIG. 2 illustrates a side elevational view of the diffusor assembly of FIG. 1 shown in assembled form.
Figure 3:
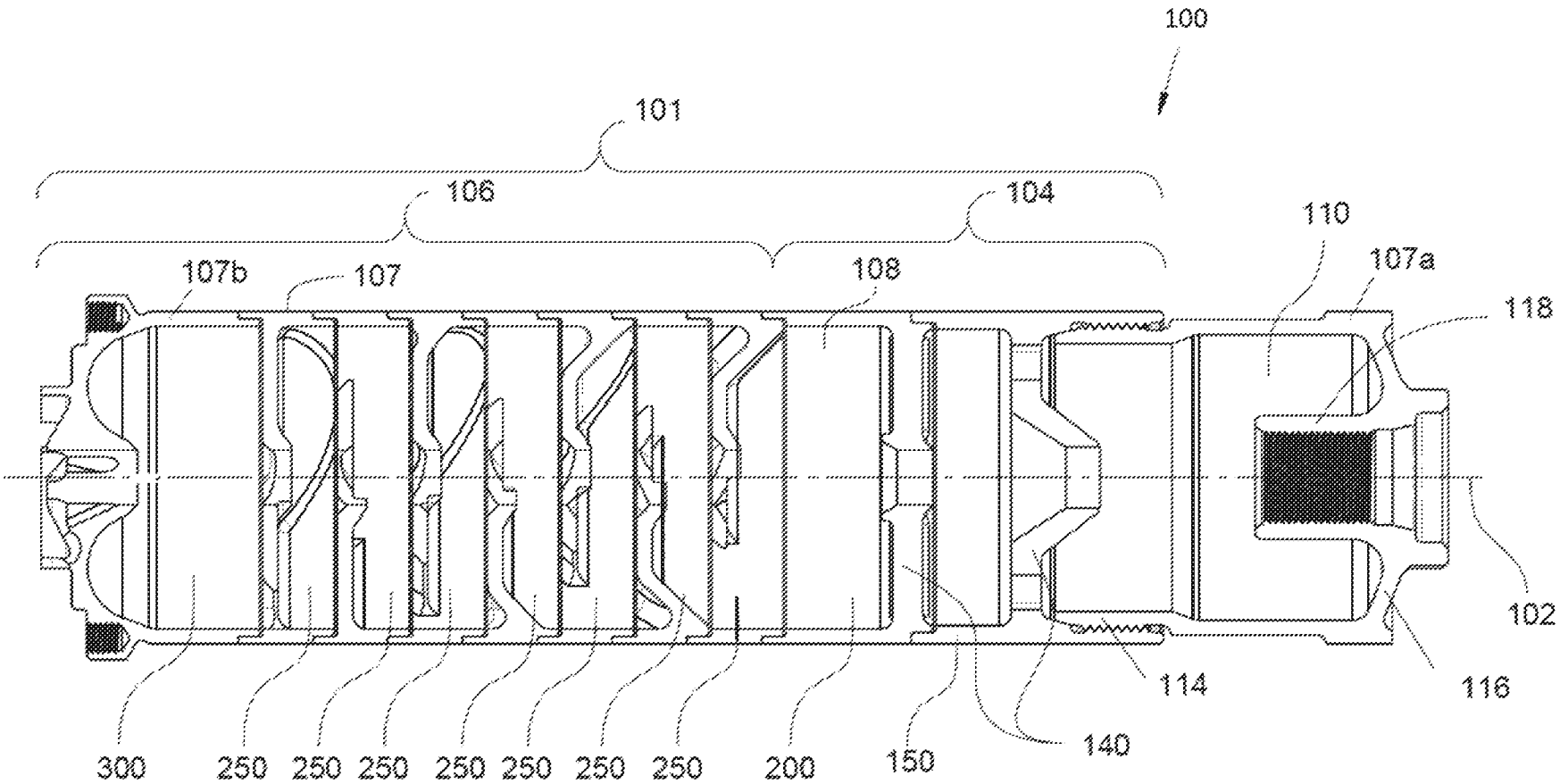
FIG. 3 illustrates a side, cross-sectional view of the suppressor assembly of FIG. 1 shown in assembled form.

FIGS. 1, 2, and 3 illustrate various views of a suppressor assembly 100 in accordance with an embodiment of the present disclosure. FIG. 1 illustrates an exploded, isometric view of the suppressor assembly 100, which includes a suppressor 110 and a diffusor assembly 101. FIG. 2 illustrates a side elevational view of the diffusor assembly 101 with a hollow tubular body 107, a sealing and locking surface 165, and a threaded barrel mount 118. FIG. 3 illustrates a side, cross-sectional view of the suppressor assembly 100, where the suppressor 110 is assembled to the diffusor assembly 101 and includes a barrel mount 118 recessed into the suppressor proximal end 116.

In one embodiment, the diffusor assembly 101 includes a diffusor portion 104 and a signature-reduction portion 106 aligned axially, where the signature-reduction portion 106 is located distally of the diffusor portion 104. The diffusor assembly 101 has a hollow, tubular body 107 extending along a central axis 102 from a proximal end 107*a* to a distal end 107*b*. In one embodiment, the signature-reduction portion 106 is fixedly attached to the diffusor portion 104 as a single, monolithic unit that is configured to be coupled to the suppressor 110. For example, the suppressor 110 is configured to couple to the muzzle 1004 of the host firearm 1000 (shown, e.g., in FIG. 1A) and the diffusor assembly 101 is configured to attach to the suppressor distal end 114.

In one embodiment, the suppressor proximal end portion 116 is configured to attach to the distal barrel end portion 1002*a* of the host firearm 1000, such as with a threaded barrel mount 118 on the suppressor 110. In some embodiments, the diffusor assembly 101 is permanently assembled as a single unit, such as by welding together components of the diffusor assembly 101, or through the process of additive manufacturing. In other embodiments, the diffusor assembly 101 is reversibly assembled. For example, components of the diffusor assembly 101 may use threaded interfaces to allow for disassembly for cleaning, maintenance, and substitution of parts. In some embodiments, the diffusor assembly 101 and suppressor 110 are permanently assembled as a single unit of the suppressor assembly 100, such as by welding together the diffusor assembly 101 and the suppressor 110, or through the process of additive manufacturing. As shown in FIG. 3, for example, the diffusor portion 104 and signature-reduction portion 106 can be combined into a single unit of the diffuser assembly 101, such as where the diffusor assembly 101 is threadably and removably attached to the suppressor 110.

In accordance with an embodiment of this disclosure, the diffusor assembly 101 includes a diffusor portion 104 and a signature-reduction portion 106. The diffusor portion 104 may be a single-stage diffusor having a first diffusor portion 150, or a two-stage diffusor 140 comprising a first diffusor portion 150 and a second diffusor portion 200. In yet other embodiments, the diffusor portion 104 has three or more stages as deemed appropriate for the caliber of the firearm and other practical considerations. The signature-reduction portion 106 includes a plurality of baffles 250 and a distal cap 300 connected in succession and arranged along the central axis 102. The diffusor portion 104, baffles 250, and distal cap 300 can be assembled with the adjacent component, where the diffusor assembly 101 in assembled form has a generally cylindrical geometry extending along the central axis 102. Other cross-sectional shapes are acceptable, including ovoid, rectangular, polygonal, and other shapes. Components of the diffusor assembly 101 are discussed in more detail below in accordance with an embodiment of this disclosure.

Figure 4A:
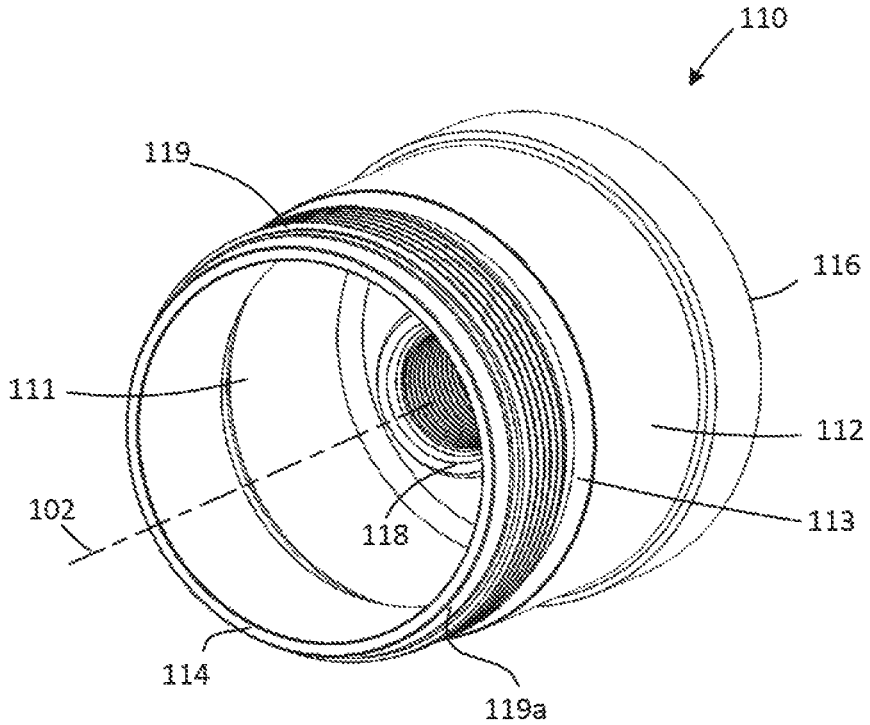
FIG. 4A illustrates a distal-end and side perspective view of a proximal suppressor in accordance with an embodiment of the present disclosure.
Figure 4B:
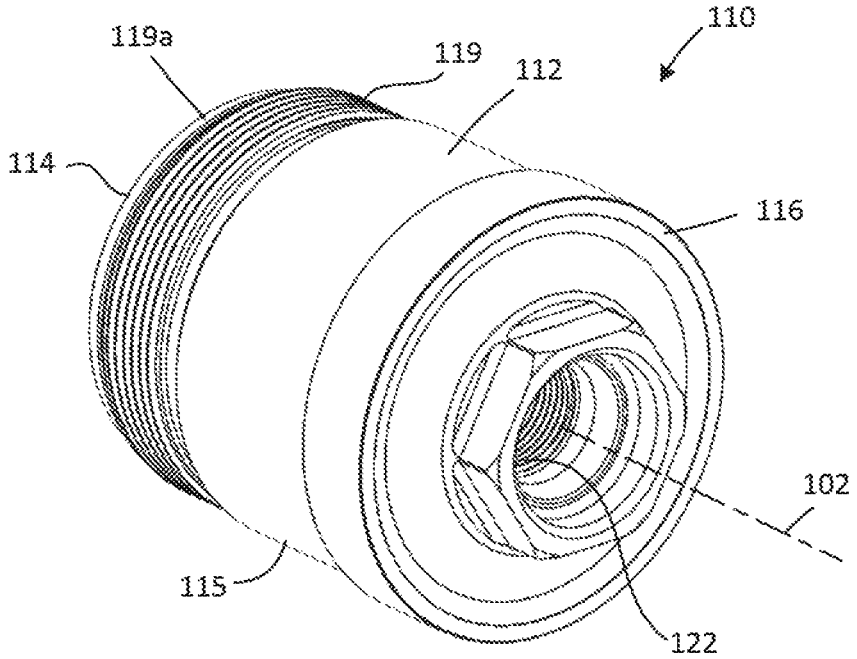
FIG. 4B illustrates a proximal-end and side perspective view of the proximal suppressor of FIG. 4A showing a barrel mount in accordance with an embodiment of the present disclosure.
Figure 4C:
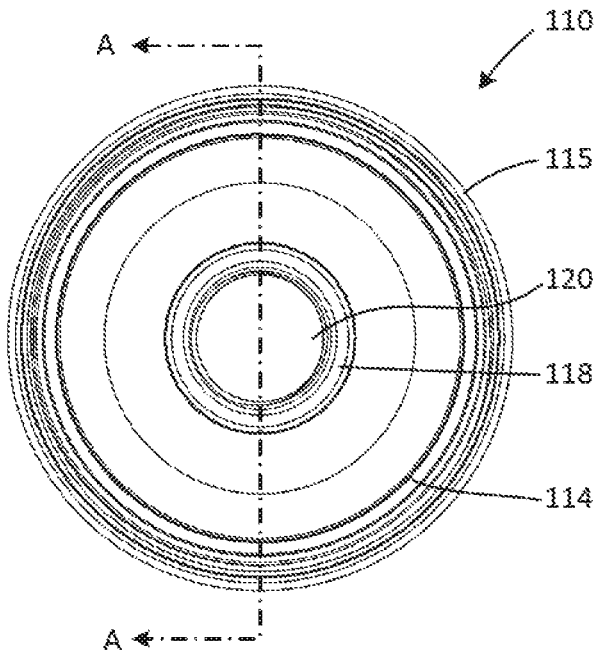
FIG. 4C illustrates an elevational view looking at the suppressor distal end portion of FIG. 4A.
Figure 4D:
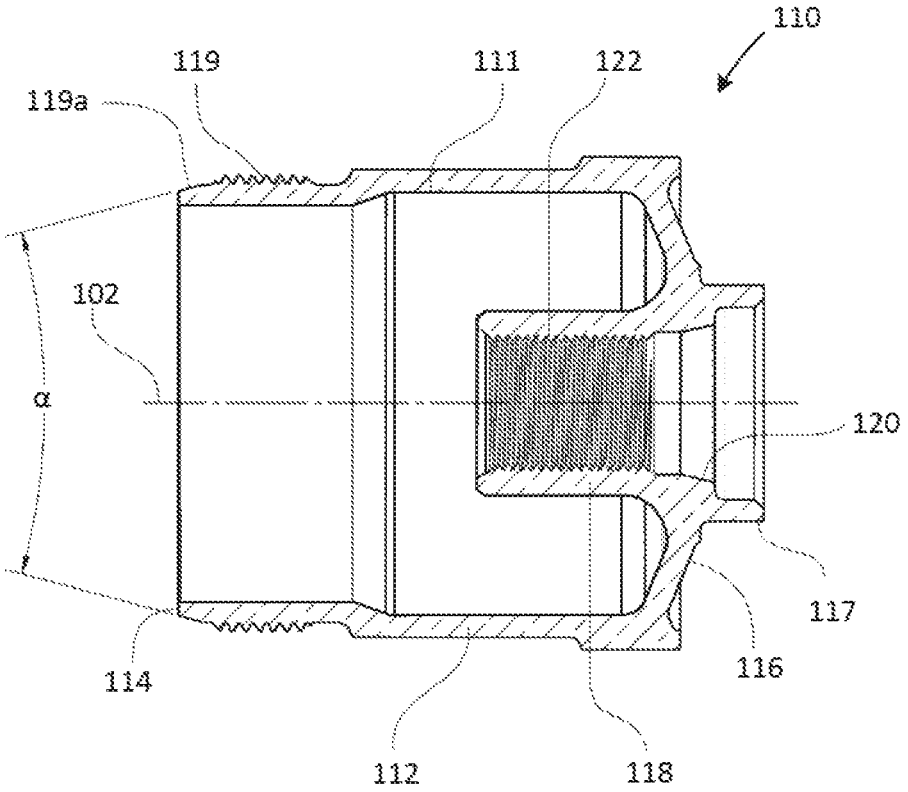
FIG. 4D illustrates cross sectional view of a proximal suppressor in accordance with another embodiment of a proximal diffusor cap of this disclosure.

Referring now to FIGS. 4A-4D, the suppressor 110 is shown in accordance with an embodiment of the present disclosure. FIG. 4A illustrates a distal-end and side perspective view showing mounting threads 119 and a tapered sealing surface 119*a* for sealing high-pressure gases when the suppressor 110 is attached to the diffusor 140; FIG. 4B illustrates a proximal-end and side perspective view showing internal threads 122 of the barrel mount 118; FIG. 4C illustrates an elevational view looking into the suppressor distal end portion 114; and FIG. 4D illustrates a sectional view taken along line A-A of FIG. 4C.

Suppressor 110 includes a suppressor body 112 extending along a central axis 102 between an open suppressor distal end 114 and a generally closed suppressor proximal end portion 116. The suppressor body 112 has an inside surface 111 and an outside surface 115. The suppressor proximal end portion 116 has a barrel mount 118 configured for attachment to the distal barrel end portion 1002*a* of the host firearm 1000 (shown in FIG. 1A). The barrel mount 118 defines a central bore 120 aligned with and extending along the central axis 102. In one embodiment, the barrel mount 118 extends proximally from suppressor proximal end portion 116. In other embodiments, such as shown in FIG. 3, the barrel mount 118 is recessed axially into the suppressor proximal end portion 116. In one embodiment, for example, the barrel mount 118 defines internal threads 122 for engaging a threaded distal barrel end portion 1002*a*. The barrel mount 118 optionally defines external threads (not shown) for attachment of accessories, such as a heat shield (not shown).

The suppressor 110 can be coupled with the muzzle 1004 such that the bore 1003 of the muzzle 1004 comes into physical register with the central bore 120 formed through the suppressor 110 along the central axis 102. The central bore 120 is suitably sized commensurate with a projectile to be fired therethrough from host firearm 1000 (shown in FIG. 1A). In one embodiment, for example, the central bore 120 has a diameter of about 0.5 inch, consistent with the diameter of a threaded distal barrel end portion 1002*a*. In some embodiments, the suppressor proximal end portion 116 may include wrench flats 117 to facilitate securing the suppressor to the host firearm 1000.

Figure 1A:
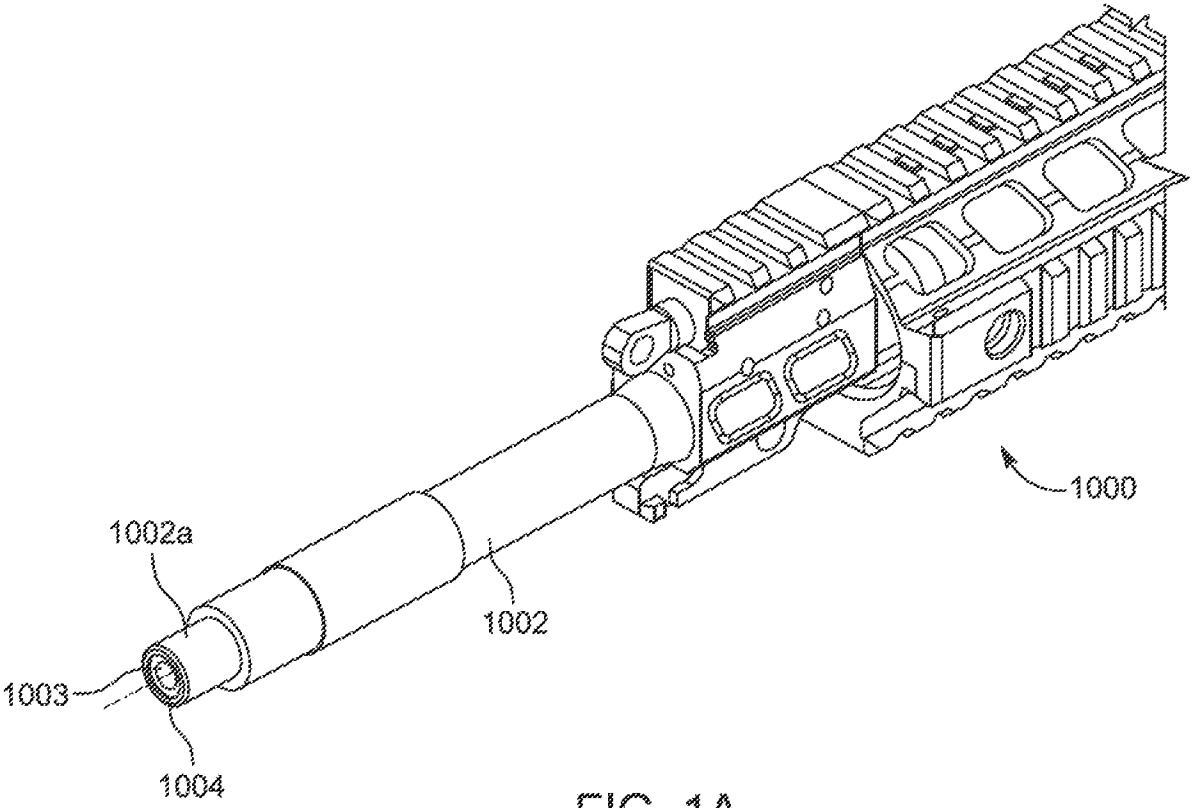
FIG. 1A illustrates a portion of a host firearm with a barrel and muzzle as may be used with embodiments of a suppressor assembly in accordance with embodiments of the present disclosure.

The suppressor 110 is configured to be operatively coupled temporarily or permanently with a muzzle 1004 of a host firearm 1000, such as illustrated in FIG. 1A. Embodiments of the suppressor 110 are configured according to the geometry and engagement structure (e.g., threads) of the respective barrel 1002 so that the suppressor 110 can be securely and operatively coupled with the muzzle 1004 with the bore 1003 aligned along the central axis 102. In addition to threaded engagement with the barrel 1002, other temporary or permanent engagement structures may also be employed, including, but not limited to, a bayonet mount, a slip fit with a set screw, a coupler, or a weld. Accordingly, the suppressor 110 is constructed to operably engage and be mounted on the distal barrel end portion 1002*a*.

In some embodiments, it may be advantageous to removably connect the suppressor 110 to the diffusor assembly 101 for the purpose of cleaning, replacing worn or damaged parts, or other foreseeable purposes. In one example, the threaded connection between the suppressor 110 and the diffusor assembly 101 is secure and free of gas leaks when exposed to the elevated internal pressures of the suppressor assembly 100. In some embodiments, the suppressor distal end 114 has a tapered sealing surface 119*a* with an included angle $\alpha$. The sealing surface 119*a* can be configured to matingly engage a corresponding tapered sealing surface 165 in the diffuser portion 104, also with included angle $\alpha$. The angle $\alpha$ is selected, for example, to form a secure seal that will resist loosening even under extremes of temperature, pressure, shock, and vibration. For example, the tapered surfaces 165, 119*a* lock the two parts together to prevent loosening of the threaded connection during use, while the threaded connection still allows the suppressor 110 to be disassembled from the barrel end portion 1002*a* using hand tools, such as for cleaning, inspection, and reassembly or replacement.

Figure 5A:
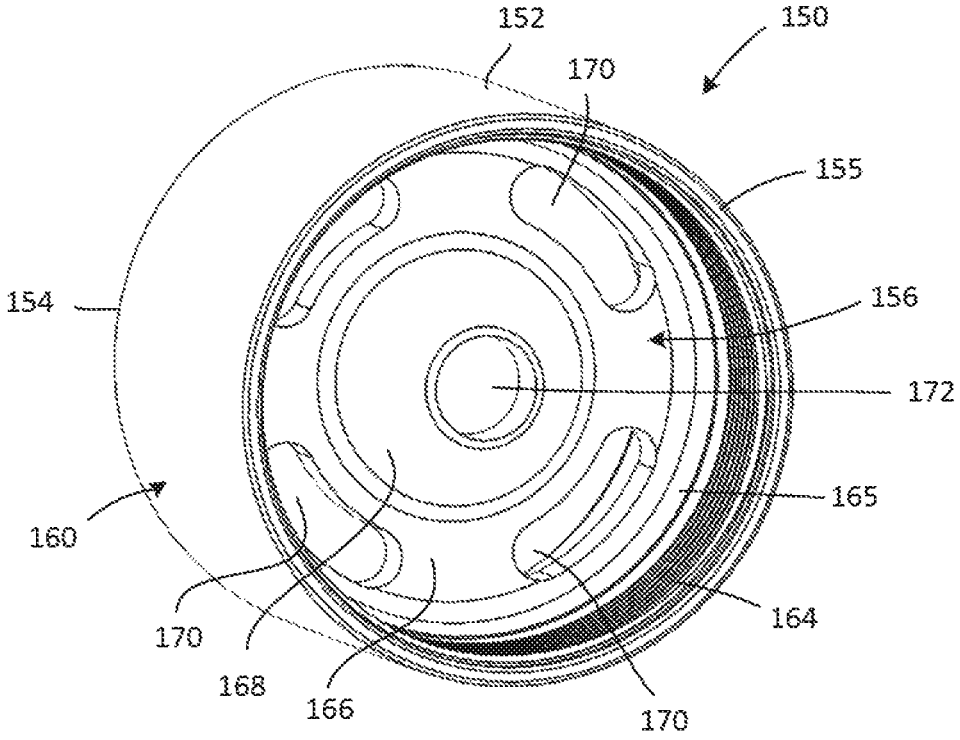
FIG. 5A illustrates a side and proximal-end perspective view of a first diffusor portion in accordance with an embodiment of the present disclosure.
Figure 5B:
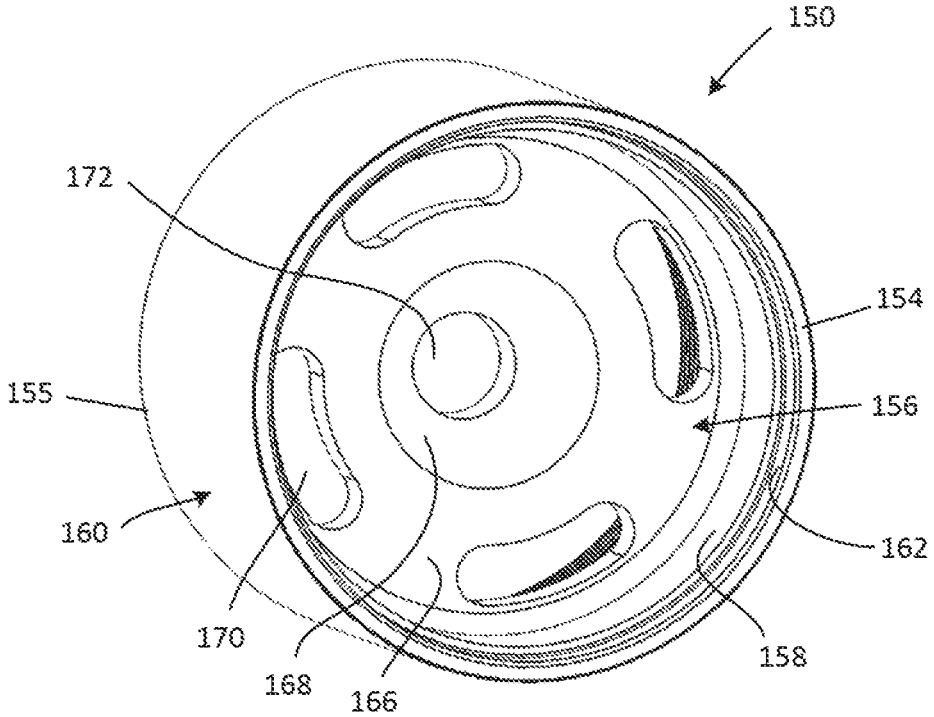
FIG. 5B illustrates a side and distal-end perspective view of the first diffusor portion of FIG. 5A.
Figure 5C:
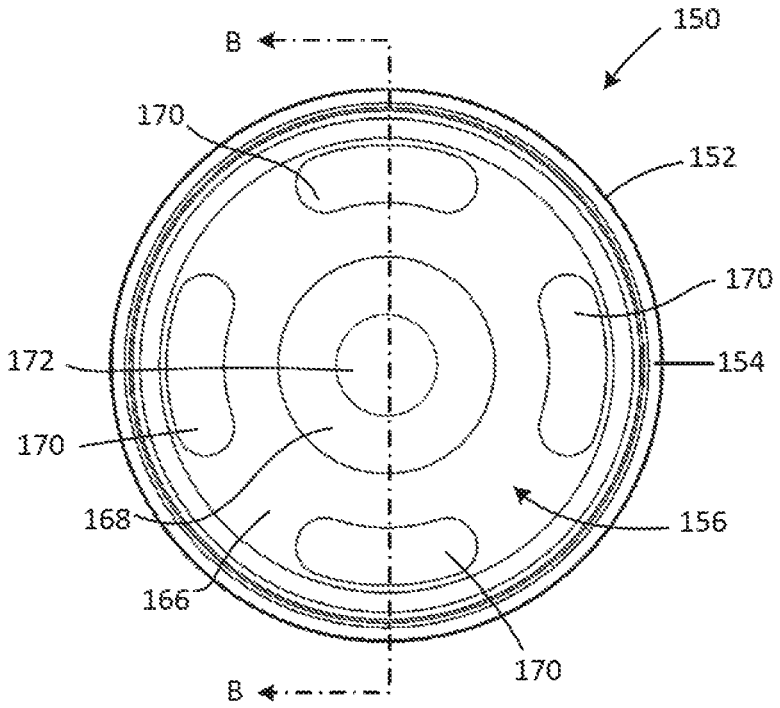
FIG. 5C illustrates an elevational view looking at the distal end the first diffusor portion of FIG. 5A.
Figure 5D:
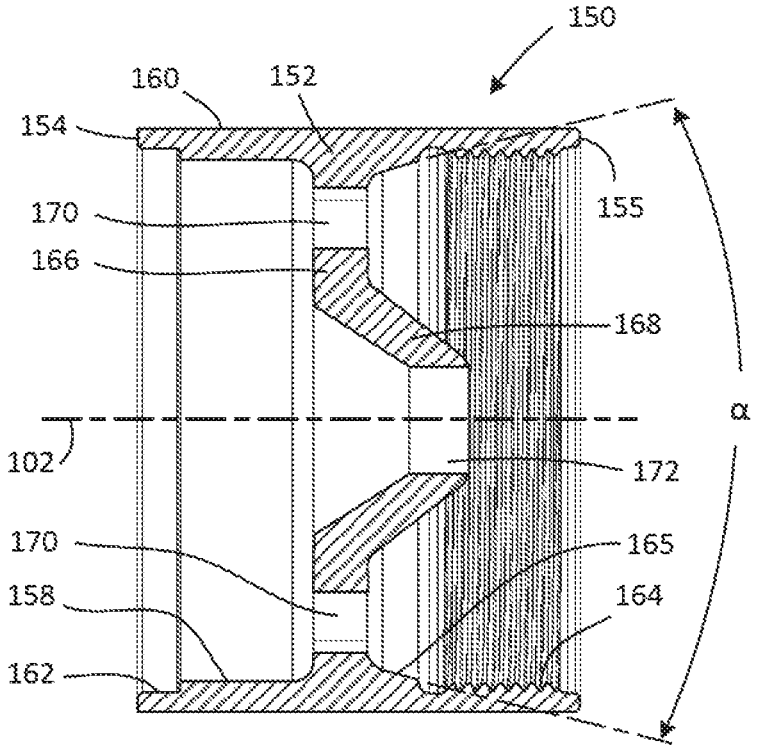
FIG. 5D illustrates a side elevational section taken along line B-B of FIG. 5C.

Referring now to FIGS. 5A-5B, a first diffusor portion 150 of the diffusor 140 is illustrated in accordance with an embodiment of this disclosure. FIG. 5A illustrates a side and proximal-end perspective view; FIG. 5B illustrates a side and distal-end perspective view; FIG. 5C illustrates an elevational view looking at distal end 154; and FIG. 5D illustrates a side elevational section taken along line B-B of FIG. 5C.

The first diffusor portion 150 has a solid-walled first diffusor body 152 extending along central axis 102 from a first diffusor distal end 154 to a first diffusor proximal end 155. In one embodiment, the diffusor body 152 is one portion of the tubular body 107 of the diffusor assembly 101 as shown in FIG. 2, for example. The first diffusor body 152 has an inside body surface 158 and an outside body surface 160. The inside body surface 158 of the first diffusor body 152 defines an annular recess 162 adjacent the first diffusor distal end 154. The inside body surface 158 also may define a female thread 164 and an annular tapered sealing surface 165 adjacent the first diffusor proximal end 155. In one embodiment, the recess 162 is configured to receive and overlap an adjacent component of the diffusor assembly 101, such as one of the baffles 250 or a second diffusor portion 200.

A first diffusor baffle 156 is connected to and extends across the inside of the first diffusor body 152. In some embodiments, the first diffusor baffle 156 is located at or adjacent the first diffusor proximal end 155. In other embodiments, the first diffusor baffle 156 is located between the first diffusor distal and 154 and the first diffusor proximal end 155, or at the first diffusor distal end 154.

In one embodiment, the first diffusor baffle 156 includes a flat or planar portion 166 connected to the first diffusor body 152 and extending radially inward. The planar portion 166 is oriented generally perpendicularly to the central axis 102 and connects to a diffusor protrusion 168 that is centered on the central axis 102 and extends proximally from the planar portion 166. In some embodiments, the first diffusor baffle 156 is conical, domed, or flat across the inside of the first diffusor body 152. In other embodiments, the diffusor protrusion 168 has a domed or generally frustoconical shape that defines a first diffusor central opening 172 commensurate in size with a projectile to be fired therethrough. In one embodiment, for example, the first diffusor central opening 172 has a diameter of about 0.335 inch suitable for use with a 0.223 inch/5.56 mm projectile 1010 or other diameter sufficiently large for passage therethrough of projectile 1010.

In one embodiment, the first diffusor baffle 156 defines a plurality of first diffusor outer openings 170 located adjacent the inside body surface 158 of the first diffusor body 152. In one embodiment, for example, each first diffusor outer opening 170 is shaped as an arcuate slot with rounded ends and extending along a 45° sector of the planar portion 166. In one embodiment, the first diffusor outer openings 170 are distributed circumferentially with equal spacing around the first diffusor baffle 156. For example, the first diffusor openings 170 are located at the 12 o'clock, 3 o'clock, 6 o'clock, and 9 o'clock positions on the first diffusor baffle 156. Other configurations and arrangements of the first diffusor openings 170 are acceptable. Each first diffusor outer opening 170 may be positioned immediately adjacent inside body surface 158 of first diffusor body 152 or radially inset therefrom. In accordance with some embodiments, the sum of the areas of the first diffusor outer openings 170 is at least three times the area of the first diffusor central opening 172. For example, the sum of the areas is at least five, ten, fifteen, or twenty times the area of the first diffusor central opening 172. As propellant gases leave the barrel, the first diffusor baffle 156 separates the propellant gases 1012 into a majority portion that passes through the first diffusor outer openings 170 and a minority portion that passes through the first diffusor central opening 172. In some embodiments, at least 60%, at least 70%, at least 80% or some other majority portion of the propellant gases 1012 passes through the first diffusor outer openings 170.

In some embodiments, the first diffusor baffle 156 is configured to sufficiently slow down the propellant gases 1012 such that the projectile 1010 remains in front of the propellant 1012 gases during its entire path through the suppressor assembly 100. This feature contrasts a muzzle blast from some barrels that lack an attachment, where the propellant gases expand around and flow in front of the projectile to some extent. When discharging the host firearm 1000 equipped with the suppressor assembly 100, a projectile 1010 passes axially through the first diffusor central opening 172, followed by a first portion 1012*a* of propellant gases 1012 passing through the first diffusor central opening 172 and a second portion 1012*b* of the propellant gases 1012 is diverted by the first diffusor baffle 156 and passing through first diffusor outer openings 170.

Figure 6A:
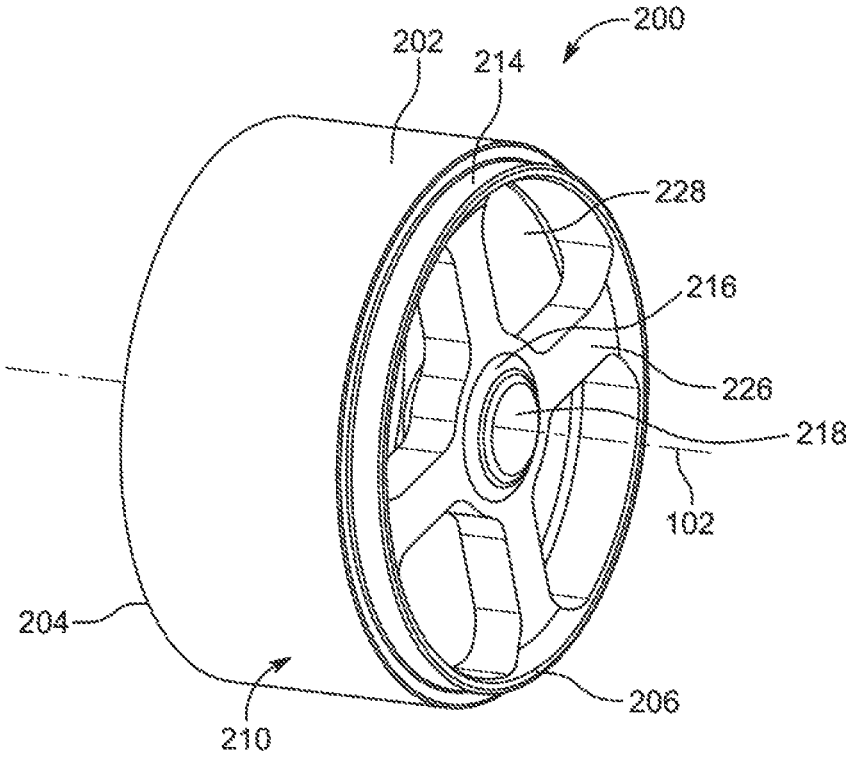
FIG. 6A illustrates a perspective view of second diffusor proximal end in accordance with an embodiment of a second diffusor portion of the present disclosure.
Figure 6B:
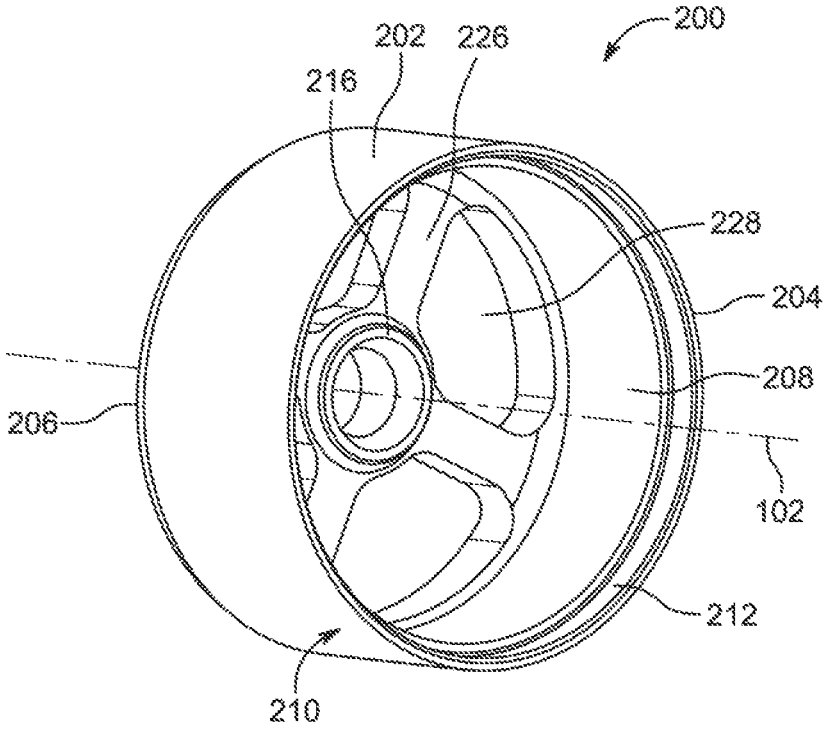
FIG. 6B illustrates a perspective view of second diffusor distal end.
Figure 6C:
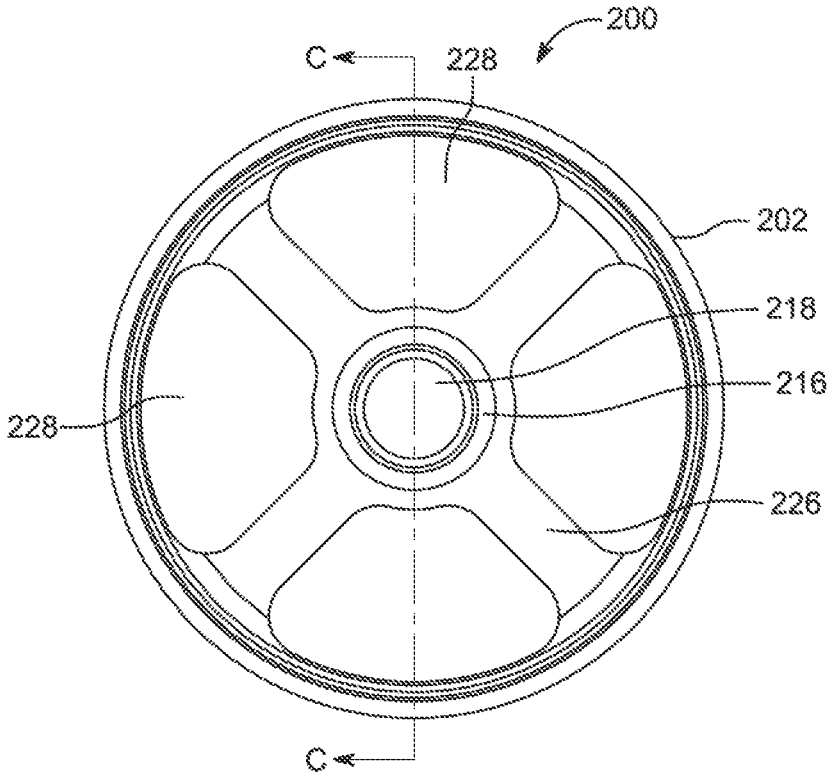
FIG. 6C illustrates an elevational view looking at second diffusor proximal end.
Figure 6D:
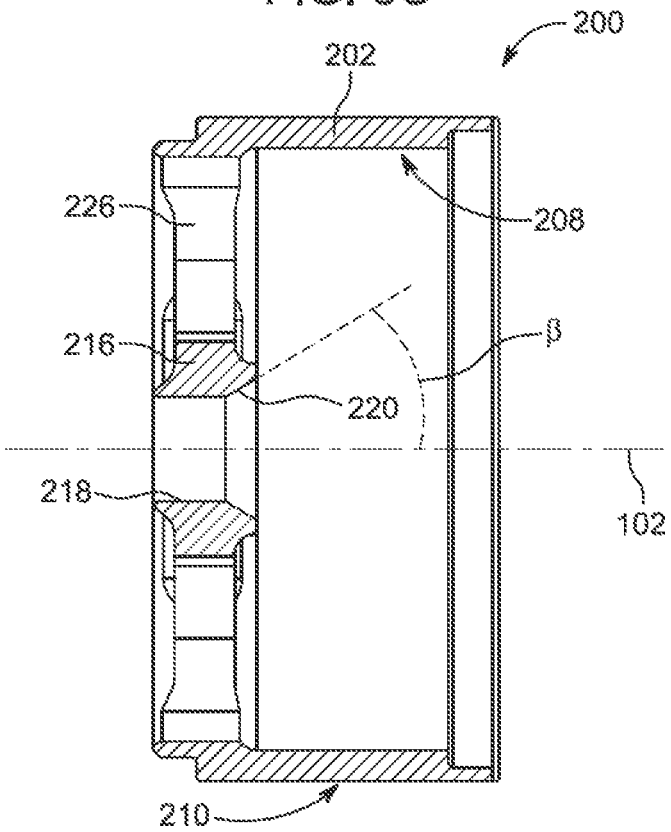
FIG. 6D illustrates a sectional view taken along line C-C of FIG. 6C.

Referring now to FIGS. 6A-6D, a second diffusor portion 200 is illustrated in accordance with an embodiment of the present disclosure. FIG. 6A illustrates a perspective view of the second diffusor proximal end 206; FIG. 6B illustrates a perspective view of the second diffusor distal end; FIG. 6C illustrates a proximal elevational view; and FIG. 6D illustrates a cross sectional view taken along line C-C of FIG. 6C.

In one embodiment, the second diffusor portion 200 has a solid-walled second diffusor body 202 extending along central axis 102 from a second diffusor distal end 204 to a second diffusor proximal end 206. The second diffusor body 202 has an inside body surface 208 and an outside body surface 210. Similar to first diffusor portion 150 discussed above, the inside body surface 208 defines an annular recess 212 adjacent the second diffusor distal end 204. The outside body surface 210 defines an annular recess 214 adjacent the second diffusor proximal end 206. Recesses 212, 214 can be along the inside surface or outside surface as appropriate to receive or be received by and overlap adjacent components of the diffusor assembly 101. For example, recess 212 is configured to receive and overlap a baffle 250, which is discussed in more detail below; recess 214 is configured to be received by and overlap the recess 162 of the first diffusor portion 150.

A diffusor hub 216 is centered on the central axis 102 and defines a second diffusor central opening 218 with a size commensurate with a projectile 1010 to be fired therethrough. In one embodiment, for example, the second diffusor central opening 218 has a diameter of 0.295 inch for use with a 0.223 inch/5.56 mm projectile 1010. The second diffusor central opening 218 can have another diameter sufficiently large for passage therethrough of projectile 1010. In some embodiments as shown in FIG. 6D, the second diffusor central opening 218 is formed with a beveled distal opening surface 220. For example, the beveled distal opening surface 220 defines a bevel angle β of about 30° with respect to the central axis 102 (or about 60° inclusive between opposite beveled surfaces of distal opening 220). For example, the beveled distal opening surface 220 has a diameter of about 0.4 inch in one embodiment when second diffusor central opening 218 has a diameter of 0.295 inch. The beveled distal opening surface 220 facilitates propellant gases 1012 expanding and flowing away from the central axis 102 as the gases exit the second diffusor central opening 218.

A plurality of diffusor spokes 226 extend radially outward from the diffusor hub 216 and connect to the second diffusor body 202. As such, the diffusor spokes 226 define a plurality of second diffusor outer openings 228 disposed between adjacent diffusor spokes 226 and spaced radially outward from the second diffusor hub 216. In one embodiment, for example, the second diffusor portion 200 has four diffusor spokes 226 arranged in a cross or plus shape (i.e., rotationally arranged 90° from each other). Accordingly, the second diffusor portion 200 has four second diffusor outer openings 228 also positioned 90° from each other. In one embodiment, each of the second diffusor outer openings 228 has the shape of a sector or a trapezoid with curved inner and outer radial edges. Other numbers of diffusor spokes 226 can be used, such as three, five, six, etc. Also, other shapes are acceptable for each second diffusor outer openings 228, including a group of openings with a circular or other shape, a group of slots, a single opening with any suitable shape, and the like.

Similar to the first diffusor portion 150, and in accordance with an embodiment of the present disclosure, the combined area of second diffusor outer openings 228 is significantly greater than second diffusor central opening 218. For example, the sum of the areas of the second diffusor outer openings 228 is at least three times the area of the first diffusor central opening 218. For example, the sum of the areas is at least five, ten, fifteen, or twenty times the area of the second diffusor central opening 218. In some such embodiments, a majority portion the propellant gases 1012 passes through the second diffusor outer openings 228 and a minority portion of the propellant gases 1012 passes through the second diffusor central opening 218. In some embodiments, at least 60%, at least 70%, at least 80% or some other majority portion of the propellant gases 1012 passes through the second diffusor outer openings 228. Such a configuration can be useful to direct propellant gases through the outer openings 170, 228, as will be appreciated.

When the second diffusor portion 200 is assembled with the first diffusor portion 150, the second diffusor central opening 218 is axially aligned with the first diffusor central opening 172 and centered on central axis 102, in accordance with an embodiment of the present disclosure. In some embodiments, the second diffusor outer openings 228 may be rotationally misaligned with the first diffusor openings 170. For example, the first diffusor outer openings 170 are rotated 30° to 60° out of alignment with respect to the second diffusor outer openings 228. In one such embodiment, the first diffusor outer openings 170 are rotated 45° out of alignment with the second diffusor outer openings 228 so that each of the diffusor spokes 226 is axially aligned with a center of one of the first diffusor openings 170.

Figure 7A:
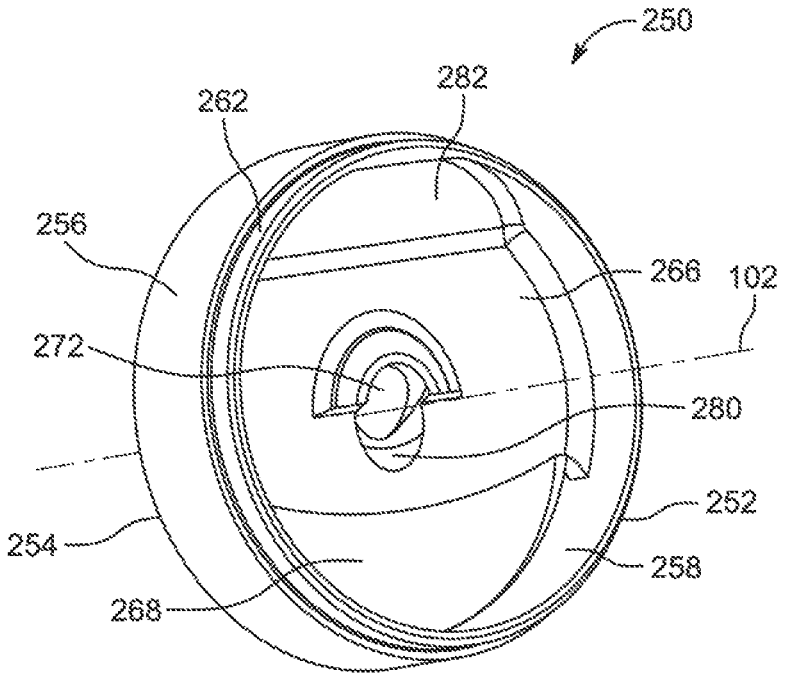
FIG. 7A illustrates a perspective view of a baffle body proximal end showing the central baffle opening and a protrusion in accordance with an embodiment of a baffle of the present disclosure.
Figure 7B:
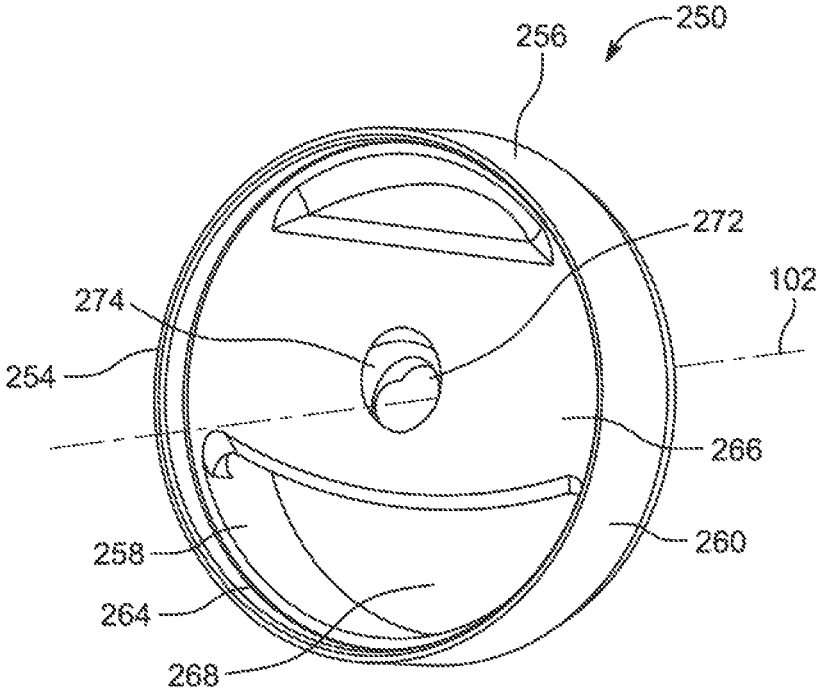
FIG. 7B illustrates a perspective view of a baffle body distal end of FIG. 7A.
Figure 7C:
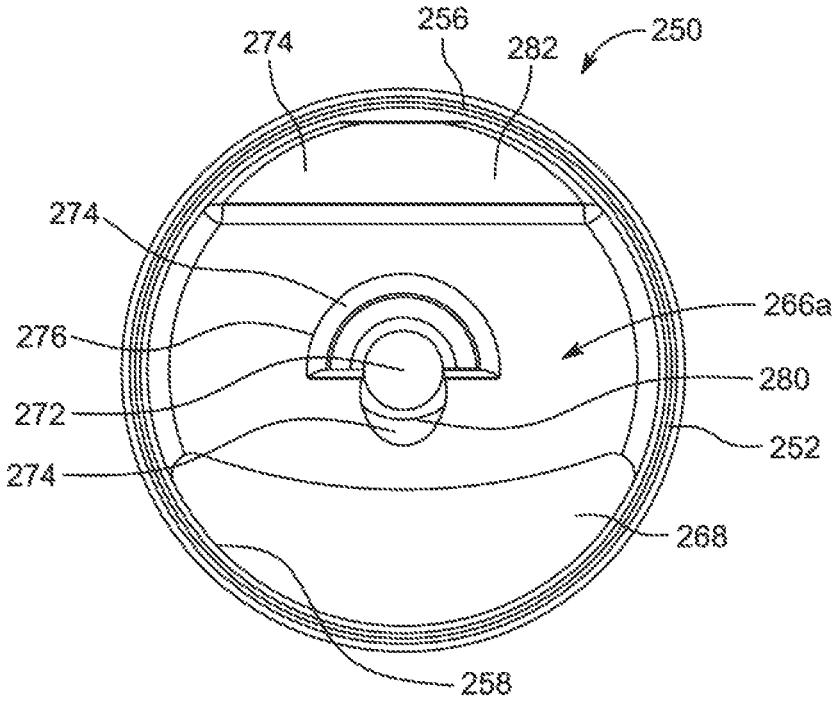
FIG. 7C illustrates an elevational view looking at baffle body proximal end of FIG. 7A.
Figure 7D:
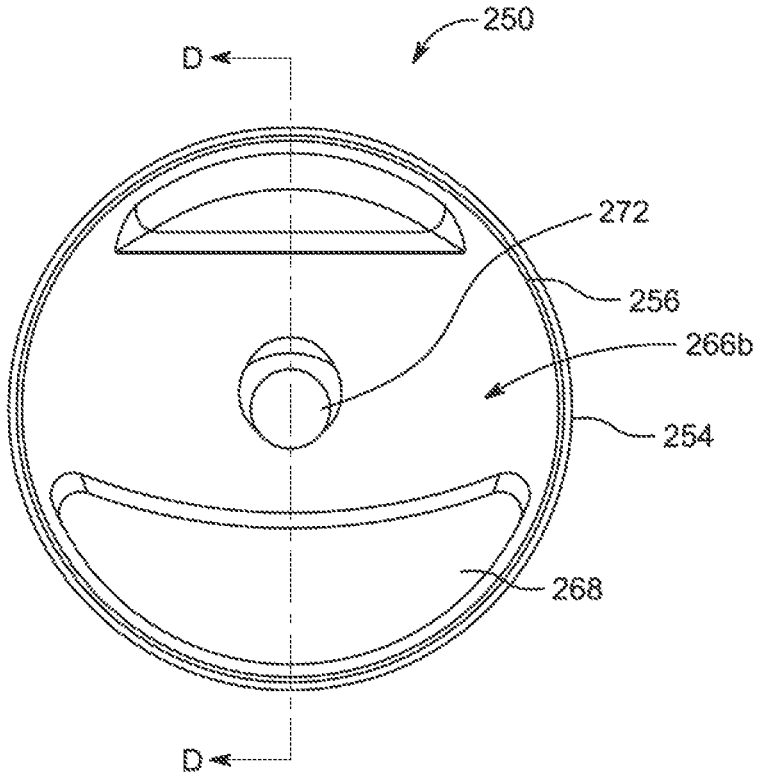
FIG. 7D illustrates an elevational view showing the distal end of the baffle of FIG. 7A.
Figure 7E:
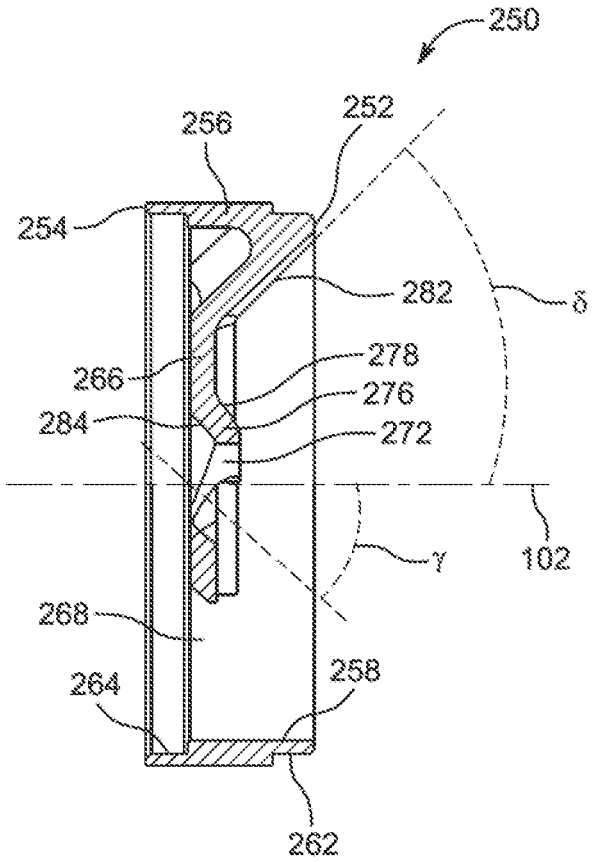
FIG. 7E illustrates a section taken along line D-D of FIG. 7D.

Referring now to FIGS. 7A-7E, a signature-reduction baffle 250 (or simply "baffle") is illustrated in accordance with an embodiment of this disclosure. FIG. 7A illustrates a perspective view of a baffle body proximal end 252 showing a central baffle opening 272 and protrusion 276; FIG. 7B illustrates a perspective view of a baffle body distal end 254; FIG. 7C illustrates an elevational view looking at baffle body proximal end 252; FIG. 7D illustrates an elevational view looking at baffle body distal end 254; and FIG. 7E illustrates a section taken along line D-D of FIG. 7D.

In one embodiment, the signature-reduction baffle 250 has a solid-walled, annular baffle body 256 that extends axially between a baffle body proximal end 252 and a baffle body distal end 254. The baffle body 256 is a part of tubular body 107 of the diffusor assembly 101 as shown, for example, in FIG. 2. The baffle body 256 has a baffle body inner surface 258 and a baffle body outer surface 260. The baffle body outer surface 260 defines an outer annular recess 262 adjacent the baffle body proximal end 252. The baffle body inner surface 258 defines an inner annular recess 264 adjacent the baffle body distal end 254. An outer annular recess 262 is configured to be received by an adjacent signature-reduction baffle 250 or some other component of the diffusor assembly 101. Similarly, the inner annular recess 264 is configured to receive an adjacent signature-reduction baffle 250 or other component of the diffusor assembly 101.

According to an embodiment of this disclosure, the outer annular recess 262 and the inner annular recess 264 of the baffle body 256 may be threaded or define some other engagement structure to engage an adjacent baffle 250 or other component of the diffusor assembly 101. Examples of other such engagement structures include a slot, a notch, a protrusion, a lip, a tapered surface, and a weld. In some embodiments, each signature-reduction baffle 250 is configured to result in precise rotational alignment about the central axis 102 with an adjacent baffle 250 when assembled together. For example, the threaded inner annular recess 264 and threaded outer annular recess 262 are configured so that adjacent signature-reduction baffles 250 can be assembled with respective baffle ports 268 rotated about 190° (or other amount) from each other. As such, signature-reduction baffles 250, or a group of signature-reduction baffles 250, may be disassembled from the diffusor assembly 101 for cleaning and maintenance and then reassembled with the same or substantially the same (e.g., ±2°) rotational orientation between adjacent signature-reduction baffles 250.

In accordance with an embodiment of this disclosure, the signature-reduction baffle 250 has a baffle portion 266 connected to and extending across baffle body 256 in a direction transverse (e.g., substantially perpendicular) to the central axis 102. In one embodiment, the baffle portion 266 is positioned adjacent the baffle body proximal end 252. The baffle portion 266 is sized and positioned to include and define a central baffle opening 272 axially therethrough. The central baffle opening 272 has an axial through-diameter commensurate with the caliber of projectile 1010 to be fired therethrough. In one embodiment, for example, the diffusor assembly 101 is configured for use with a projectile 1010 with a diameter of 0.223 inch/5.56 mm, where central baffle opening 272 has an axial through-diameter of about 0.300 inch or other diameter sufficiently large for passage therethrough of projectile 1010. Other sizes for central baffle opening 272 are acceptable and depend in part on the size of projectile 1010 with which the diffusor assembly 101 is to be used.

A baffle port 268 through the baffle body 256 is positioned radially outside of the central baffle opening 272. For example, the baffle port 268 can be immediately adjacent the baffle body 256 or radially inset from the baffle body 256. In one embodiment, a majority of the body opening 108 is closed by the baffle body 256. For example, the baffle port 268 and central baffle opening 272 define a minority of open area compared to the closed remainder of the baffle portion 266. In some embodiments, the area of the baffle port 268 is at least three times the area of the central baffle opening 272, including at least five, ten, fifteen, or twenty times the area of the central baffle opening 272.

The baffle port 268 may have the shape of a chord, a crescent, an arc, a curved slot, or other shape. For example, the baffle port 268 substantially resembles a chord-shaped opening defined by a sector spanning about 140° to 150° of a circle when viewed axially. Other shapes for the baffle port 268 are acceptable, including a plurality of openings or slots. In some embodiments, the baffle port 268 is radially offset from the baffle body inner surface 258 to define a small wall or ridge (not shown) along the baffle body inner surface 258. Such feature may provide a more tortuous path for the propellant gases and/or facilitate heat transfer from the propellant gases 1012 to the baffle 250 and to the ambient air as the propellant gases 1012 pass through the baffle port 268.

In other embodiments, the baffle portion 266 is discontinuous along a portion of the baffle body inner surface to define the baffle port 268. In yet other embodiments, the baffle port 268 is positioned immediately adjacent the baffle body inner surface 268.

In accordance with an embodiment of this disclosure, the baffle portion 266 of the signature-reduction baffle 250 optionally defines one or more flow-directing feature 274. The flow-directing feature 274 can be located adjacent the central baffle opening 272, adjacent the baffle port 268, and/or on a face of the baffle portion 266. In one embodiment, the flow-directing feature 274 includes a protrusion 276 surrounding at least a portion of the central baffle opening 272 on the proximal face 266*a* of baffle portion 266. For example, the protrusion 276 extends from the proximal face 266*a* of the baffle portion 266 and has an arcuate or semicircular shape extending about 180° around the central baffle opening 272. The protrusion 276 functions to direct propellant gases 1012 impinging thereon to flow from the central baffle opening 272. For example, when the protrusion 176 has a semicircular shape located above the central baffle opening 272, the proximal protrusion surface 278 is sloped at about 45° with respect to the proximal face 266*a* of the baffle portion 266. As such, the protrusion 176 directs propellant gases 1012 passing axially towards the proximal protrusion surface 278 to deviate upward towards the sloped proximal baffle surface 282 and outward toward the proximal face 266*a* of baffle portion 266. Propellant gases flowing radially inward along the proximal face 266*a* (e.g., in a direction generally perpendicular to the central axis 102) are directed away from the central baffle opening 272.

In one embodiment, the protrusion 276 has a distal protrusion surface 284 that is substantially parallel to the proximal protrusion surface 278. As shown in the cross section of FIG. 7E, the protrusion 276 directs propellant gases 1012 to flow upward through central baffle opening 272 as they move through the signature-reduction baffle 250 from right to left as illustrated. Propellant gases flowing through baffle port 268 shown in FIG. 7E also may tend to flow upward and mix with propellant gases 1012 passing through the central baffle opening 272. As propellant gases 1012 expand in and flow through the chamber defined between adjacent signature-reduction baffles 250, a portion of propellant gases 1012 flowing through baffle port 268 tend to mix with propellant gases 1012 passing through central baffle opening 272. In some embodiments, the first and second portions of propellant gases 1012 mix in every chamber between adjacent signature-reduction baffles 250 or other shared volume of the suppressor assembly 100. In some embodiments, mixing of propellant gases 1012 occurs predominantly at a location offset from central axis 102.

In one embodiment, the flow-directing feature(s) 274 include a concave or flat recess 280 in proximal face 266*a* adjacent central baffle opening 272, where the recess 280 is angled with respect to the baffle proximal face 266*a*. For example, the recess 280 is located opposite of the central baffle opening 272 from the protrusion 276. In some embodiments, the baffle portion 266 alternately or additionally has an angled recess 280 in the distal face 266*b* adjacent the central baffle opening 272. When both the proximal face 266*a* and the distal face 266*b* feature angled recess 280, the respective angled recesses 280 may be positioned 180° from each other. In one embodiment, angled recess 280 results from, or is similar to, a bore formed through the baffle portion 266 at baffle bore angle γ relative to central axis 102. Thus, the central baffle opening 272 defines a flow path for propellant gases 1012 that is transverse to the central axis 102, while also defining an axial through-opening sufficiently large for projectile 1010. The shape of the axial through-opening can be circular or elliptical as viewed along the central axis 102. Baffle bore angle γ in some embodiments results in a sinuous flow path through central baffle openings 272 as propellant gases 2012 are directed away from the central axis 102 by flow-directing feature(s) 274 and gas mixing effects within the diffusor assembly 101. In one embodiment, the protrusion 276 has a distal protrusion surface 284 disposed at a baffle bore angle γ of about 45° to central axis 102. Propellant gases 1012 passing through the central baffle opening 272 are directed to follow a flow path generally along the baffle bore axis in a direction transverse to the central axis 102, for example.

In another embodiment, the flow-directing feature(s) 274 include a sloped baffle surface 282 located between the protrusion 276 and the baffle body inner surface 258, where the sloped baffle surface 282 extends transversely from the proximal face 266*a* to the baffle body inner surface 258. For example, a first portion of the baffle is oriented generally perpendicularly to the central axis 102 and defines the central baffle opening 272 and baffle port 268. The sloped baffle surface 282 is a second portion of the baffle body 256 that connects to the first portion (e.g., baffle portion 266) and extends at an angle between the proximal face 266*a* of the baffle portion 266 and the baffle body 256. In one embodiment, the sloped baffle surface 282 generally has a chord shape as viewed axially and is positioned opposite of the baffle port 268. In one embodiment, the sloped baffle surface 282 defines a slope angle δ with respect to the proximal face 266*a* of baffle portion 266. In some embodiments, the slope angle δ is from 30° to 60°, including 35°, 40°, 45°, 50°, and 55°. In some embodiments, the slope angle δ and the baffle bore angle γ are equal or substantially equal (e.g., ±2°).

When adjacent signature-reduction baffles 250 are assembled together with the baffle port 268 of one baffle 205 misaligned with the baffle port 268 of an adjacent signature-reduction baffle 250 (e.g., rotated 180°±45°), the relative orientation of baffle ports 268 and flow-directing feature(s) 274 direct a second portion 1012*b* of propellant gasses 1012 to take an elongated, less restrictive, and generally sinuous path through the signature-reduction portion 106 of the suppressor assembly 100, where the second path crosses and mixes with a first portion 1012*a* of propellant gases 1012 passing generally along the central axis 102. For example, each baffle port 268 is rotated about 180°, about 185°, about 190°, about 195°, about 200°, about 210°, about 215°, about 220°, or about 225° with respect to the baffle port 268 of an adjacent baffle 250 so that propellant gases 1012 take a helical path or pseudo-helical path through the signature-reduction portion 106 of the diffusor assembly 101. In some embodiments, each signature-reduction baffle 250 is rotated from 185°-225°, from 185° to 210°, or from 185° to 200° with respect to an adjacent signature-reduction baffle 250 consistent with rifling of the barrel 1002. For example, rotation is according to the right-hand rule.

In some embodiments, the signature-reduction portion 106 of the diffusor assembly 101 has at least four signature-reduction baffles 250 and as many as six, seven or more signature-reduction baffles 250. It has been determined experimentally that increasing the number of signature-reduction baffles 250 from four to six or seven further attenuates the audible report of host firearm 1000 by a discernable amount. The number of signature-reduction baffles 250 may be selected as needed for the desired amount of sound suppression, for the desired overall length of diffusor assembly 101, the desired overall length of the suppressor assembly 100, and for other practical considerations. Also, signature-reduction baffles 250 of different axial lengths or having variations in features may be assembled together in a single embodiment of the diffusor assembly 101.

Figure 8A:
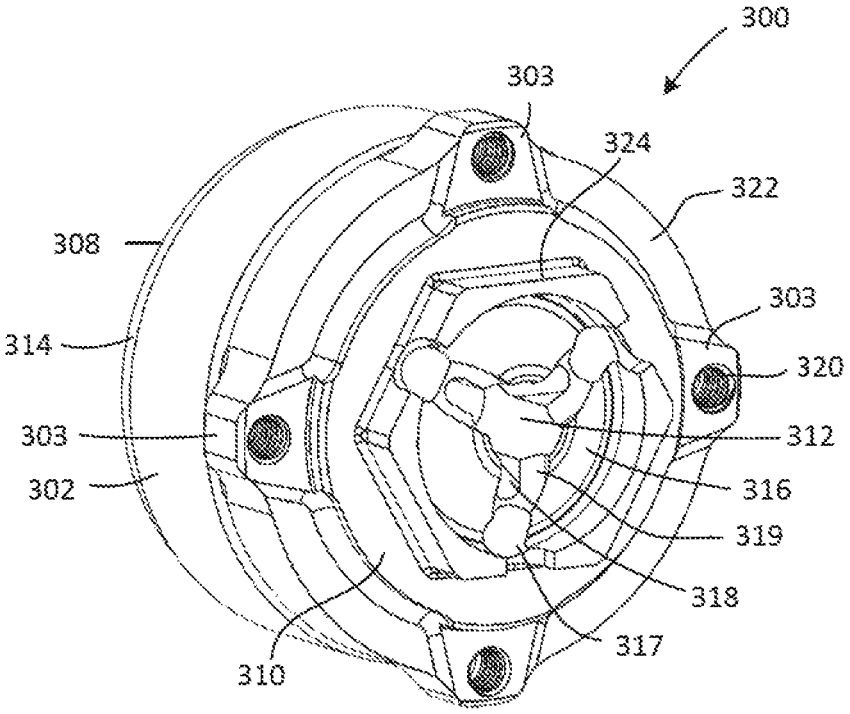
FIG. 8A illustrates a perspective view of a distal cap distal end in accordance with an embodiment of a distal cap of the present disclosure.
Figure 8B:
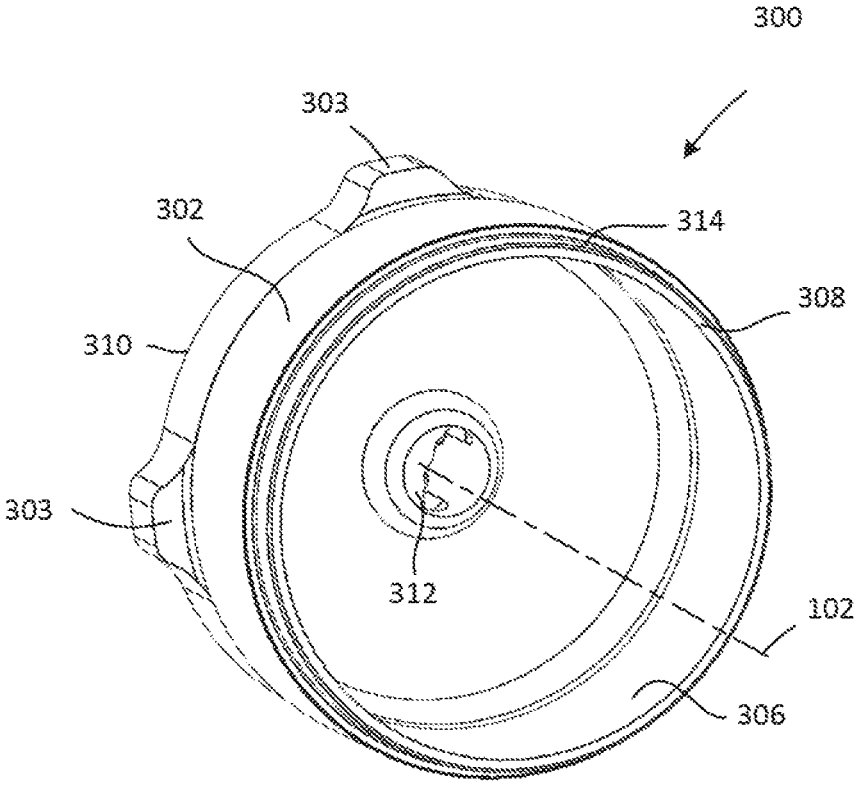
FIG. 8B illustrates a perspective view of a distal cap proximal end of the distal cap of FIG. 8A.
Figure 8C:
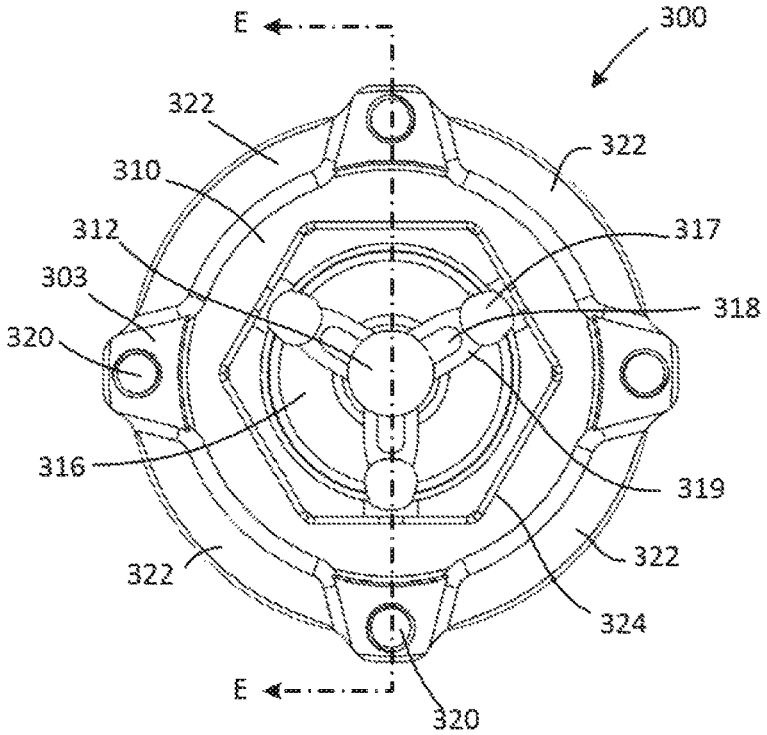
FIG. 8C illustrates an elevational view looking at the distal cap distal end of FIG. 8A.
Figure 8D:
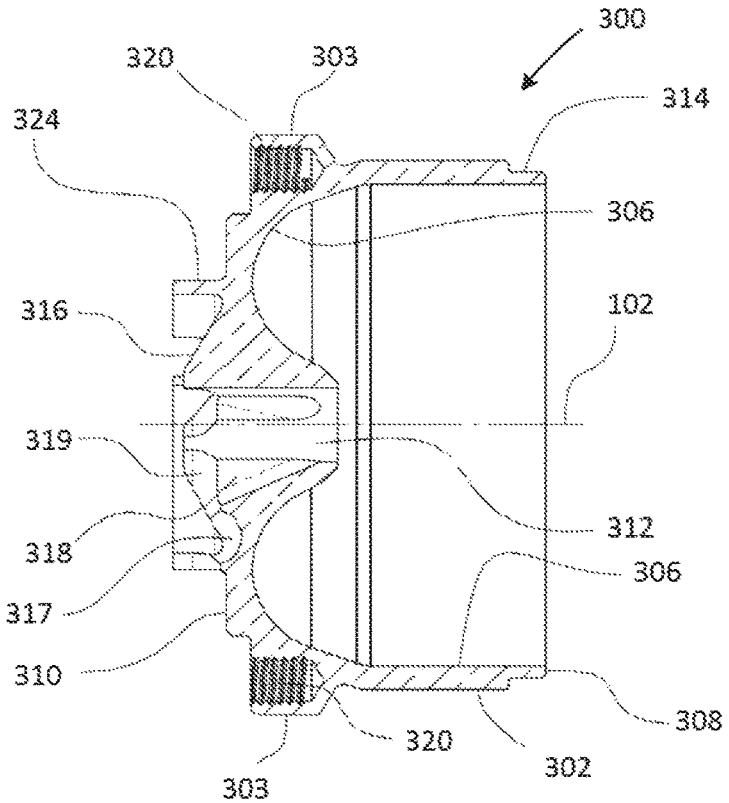
FIG. 8D illustrates a section of the distal cap taken along lines E-E of FIG. 8C.

Turning now to FIGS. 8A-8D, a distal cap 300 is illustrated in accordance with an embodiment of this disclosure. FIG. 8A illustrates a perspective view of a distal cap distal end 310; FIG. 8B illustrates a perspective view of a distal cap proximal end 308; FIG. 8C illustrates an elevational view looking at distal cap distal end 310; and FIG. 8D illustrates a section taken along line E-E of FIG. 8C.

In some embodiments, distal cap 300 has an annular distal cap body 302 with a distal cap outer surface 304 and a distal cap inner surface 306. The distal cap body 302 can be a part of tubular body 107 of the diffusor assembly 101 shown in FIG. 2, for example. The distal cap body 302 extends along the central axis 102 from the open distal cap proximal end 308 to the mostly-closed distal cap distal end 310. The distal cap distal end 310 defines a distal cap central opening 312 commensurate in size for the projectile 1010 to be fired therethrough. In one embodiment, for example, the distal cap central opening 312 has a diameter at least 2% greater than the bore 1003 of the barrel 1002 of the host firearm 1000. In one embodiment of suppressor assembly 100 configured for use with 5.56 mm projectiles 1010, for example, the distal cap central opening 312 has a diameter of about 0.30 inch or other diameter sufficiently large for passage therethrough of projectile 1010.

In one embodiment, the distal cap body 302 defines a distal cap outer recess 314 adjacent the distal cap proximal end 308. The distal cap outer recess 314 is configured to be received by inner annular recess 264 of the most distal signature-reduction baffle 250 to facilitate assembly with the signature-reduction baffle 250. As noted above for other components, the distal cap outer recess 314 may be threaded, smooth, notched, slotted, define a protrusion, or have some other engagement feature to engage the signature-reduction baffle 250.

In one embodiment, the interior surface 312 of the distal cap 300 defines a plurality of flow guides 316 along the central axis 102 to direct propellant gases 1012 out through the distal cap central opening 312. In one embodiment, each flow guide 316 is defined in part by a first cut 318 that extends radially outward and expands in size moving radially outward from the central axis 102. In one embodiment, second cuts 319 extend radially outward from the central axis 102 between each flow guide 316. In another embodiment, the first cuts 318 and second cuts 319 intersect, providing a path for pressurized gas to expand and escape from within the diffusor assembly 101. In another embodiment, each second cut 319 includes a spherical cut 317 that is spaced a short distance radially outward of the intersection of the first cut 318 and the second cut 319. As propellant gases 1012 exit the muzzle 1004, flow guides 316 and cuts 318 and 319 function as a nozzle to direct expanding propellant gases 1012 axially outward from the diffusor assembly 101. In one embodiment, for example, the distal cap 300 has three guides 316 that are distributed 120° from one another about central axis 102.

In one embodiment, the distal cap distal end 310 defines one or more flange 303 or enlarged area 303. In some such embodiments, the distal cap distal end 310 is sized to define a plurality of threaded distal-end bores 320 extending axially into the flange 303, and distributed about the distal cap central opening 312. For example, the flange 303 at distal cap distal end 310 defines three to six distal-end bores 320 threaded for fasteners for attachment of a muzzle-end accessory, such as a heat shield. Other suitable configurations of the distal cap distal end 310 are acceptable, for instance. In some embodiments, the distal cap distal end 310 defines one or more slot or distal-end recess 322 that extends circumferentially around distal cap distal end 310. In one embodiment, each distal-end recess 322 has an arcuate shape and extends between adjacent distal end bores 320.

In one embodiment as shown in the sectional view of FIG. 8D, for example, the distal cap inner surface 306 is curved along the distal cap distal end 310. As such, the distal cap inner surface 306 facilitates a portion of propellant gases 1012 swirling within the distal cap 300 before exiting through the distal cap central opening 312.

In some embodiments, the distal cap 300 optionally defines one or more external wrench flats 324 on the distal cap distal end 310, which may be utilized in securing and removing the suppressor assembly 100 from host firearm 1000, or to facilitate removal of diffusor assembly 101 from the suppressor 110. In one embodiment, for example, wrench flats 324 are positioned in a hexagonal arrangement substantially opposite one another around the distal cap central opening 312 on the distal cap distal end 310.

As will be appreciated in light of this disclosure, it may be desirable to ensure that the dimensions and alignment of the suppressor assembly 100 are configured to minimize or otherwise reduce the likelihood of a discharged projectile 1010 striking the interior of the suppressor assembly 100. To that end, and in accordance with some embodiments, openings centered on the central axis 102 may be configured, for example, such that (1) the diameter is at least as large as the bore 1003 of the barrel 1002 and/or (2) the central axis 102 of the suppressor assembly 100 substantially aligns (e.g., is precisely aligned or otherwise within an acceptable tolerance) with the bore 1003 of the barrel 1002.

Figure 9:
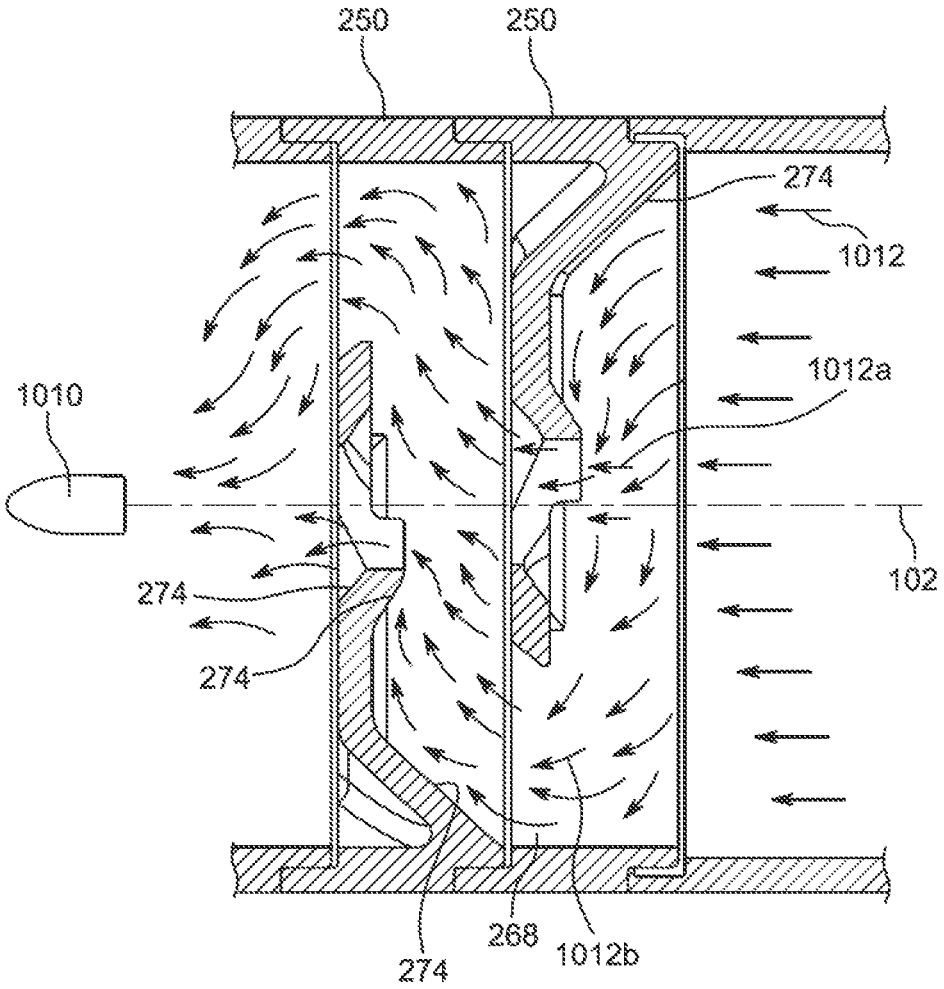
FIG. 9 illustrates a side sectional view of two baffles, propellant gases, and a projectile showing exemplary flow paths of the propellant gases through the baffles.

Referring now to FIG. 9, a sectional view illustrates two signature-reduction baffles 250 and example flow paths of the propellant gases 1012 and the projectile 1010 moving from right to left through the signature-reduction baffles 250. As the projectile 1010 passes through central baffle openings 272 along the central axis 102, pressurized propellant gases 1012 follow from the muzzle 1004. The first portion 1012*a* of propellant gases 1012 pass through the central baffle openings 272 generally along the central axis 102. In some embodiments, the first portion 1012*a* of propellant gases 1012 exhibits sinusoidal fluctuations due in part to flow-directing features 274 adjacent central baffle openings 272, and in part to mixing with the second portion 1012*b* of propellant gases 1012 following an elongated and less restrictive path through baffle ports 268. The second portion 1012*b* of propellant gases 1012 follow an elongated and less restrictive path through baffle ports 268. The second portion 1012*b* of propellant gases 1012 crosses and mixes with first portion 1012*a* of propellant gases 1012, causing propellant gases 1012 to lose momentum and velocity. The second portion 1012*b* of propellant gases 1012 also redirects some of the first portion 1012*a* of propellant gases 1012 along the elongated and less restrictive path through baffle port(s) 268. In some embodiments, the second portion 1012*b* mixes with the first portion 1012*a* in every location where the portions of the propellant gases share a volume. For example, the second portion 1012*b* mixes with the first portion 1012*a* between each stage of the suppressor assembly 100, such as between diffusor stages, between the diffusor stage and the proximal signature-reduction baffle 250, between adjacent signature-reduction baffles 250, and between the most distal signature-reduction baffle and the distal end cap.

Due to the mixing and swirling of propellant gases 1012 promoted by flow-directing feature(s) 274 and the relative orientation of adjacent baffle ports 268, propellant gases 1012 are delayed from exiting the suppressor assembly 100 and have a longer flow path. The result is that the kinetic energy and velocity of propellant gases 1012 is reduced so that a smaller portion of propellant gases 1012 impinges on the flat proximal face 266*a* of each baffle portion 266. Additionally, some propellant gases circle and swirl in a chamber defined between adjacent baffle portions 266 and further mix with propellant gases 1012 that continue to pass through central baffle opening 272 and baffle port 268 of each signature-reduction baffle 250. The crossing flow paths of the propellant gases 1012 through the central baffle opening 272 and the baffle port 268, and the multiple changes in direction of propellant gases 1012 result in improved performance in reducing the signature of the host firearm 1000. Accordingly, embodiments of suppressor assembly 100 may advantageously exhibit increased sound suppression of the audible report, self-cleaning of the diffusor assembly 101 by more effectively removing carbon particles from diffusor assembly 101, and/or an increased life of the suppressor assembly 100.

In use, the diffusor assembly 101 can be coupled to the suppressor 110, and the suppressor 110 coupled with the muzzle 1004 of the host firearm 1000, where the bore 1003 of the barrel 1002 is aligned with the central axis 102 of both the diffusor assembly 101 and the suppressor 110. Upon discharge of host firearm, the projectile 1010 leaves the muzzle 1004, passes through the suppressor 110, and then into diffusor assembly 101 along the central axis 102, followed by expanding propellant gases 1012. In some embodiments, components of the diffusor assembly 101 are affixed together as a permanent, monolithic structure by welding, additive manufacturing, or some other process. In other embodiments, components of the diffusor assembly 101 may be disassembled by the user for cleaning and maintenance.

Embodiments of a diffusor assembly 101 advantageously provide a combination of a diffusor portion 104 and a signature-reduction portion 106 in one unit. Some such embodiments provide improved flash suppression and/or improved sound suppression compared to other diffusors mounted to a muzzle and combined with a separate suppressor. Thus, embodiments of the diffusor assembly 101 overcome limitations associated with small and inefficient diffusors/muzzle brakes.

Another advantage of embodiments of diffusor assembly 101 according to the present disclosure is an elongated, less restrictive, and sinuous flow path through baffle ports 268 of the signature-reduction baffles 250. Such features can provide improved gas mixing within diffusor assembly 101. An associated benefit is that propellant gases 1012 are not trapped on one side of the diffusor assembly 101 and a more even gas pressure is realized throughout. This can also reduce the temperature rise that would otherwise occur with high-velocity gases impinging on a planar surface normal to the direction of gas flow, as well as exposing a greater percentage of the gas flow to the surface of the suppressor where the heat can be readily transferred to the ambient outside air. Further, the pressure pulses of expanding propellant gases 1012 are reduced in amplitude and duration.

As will be appreciated in light of the present disclosure, embodiments of the suppressor assembly 100 described herein may be utilized with any of a wide variety of host firearms 1000, such as a pistol, a rifle, a machine gun, or an autocannon. For example, the suppressor assembly 100 is configured to be utilized with a host firearm 1000 chambered for ammunition ranging from .22 LR to 30 mm NATO and everything in between (e.g., .22 LR, .223 Remington, .30 Remington, .380 Auto, .40 S&W, .45 Auto, .50 BMG, 5.56×45 mm NATO, 7.62×39 mm, 7.62×51 mm, 7.62×54 mm, 9×19 mm, 10×25 mm, 30×173 mm NATO, etc.). The suppressor assembly 100 may be utilized with other suitable host weapons 1000 and projectile calibers as will be apparent in light of this disclosure.

Embodiments of the suppressor assembly 100 may be constructed from any suitable material(s), as will be apparent in light of this disclosure. For example, some embodiments of suppressor assembly 100 are constructed from AISI 4130 or 4140 steel or from chromium- or austenitic nickel-chromium-based alloys, such as 17-4 Stainless Steel or Inconel alloys 625 or 718. It may be desirable in some instances to ensure that the suppressor assembly 100 comprises a material (or combination of materials), for example, that is corrosion resistant, retains strength over a large temperature range (e.g., in the range of about −50° F. to 1200° F.), and/or resistant to deformation and/or fracture at high pressures (e.g., 600-650 psi throughout and over 1000 psi in localized areas). In a more general sense, embodiments of the suppressor assembly 100 can be constructed from any suitable material which is compliant, for example, with United States Defense Standard MIL-W-13855 (Weapons: Small Arms and Aircraft Armament Subsystems, General Specification For). Other suitable materials for suppressor assembly 100 will depend on a given application and will be apparent in light of this disclosure.

In some cases, the suppressor assembly 100 and its components optionally can be configured to be operatively interfaced with any of a wide variety of other weapon accessories. For example, some embodiments may be configured to be operatively interfaced with a blank firing device as may be useful for training exercises or other instances in which blank cartridges are utilized. Some embodiments may be configured to be operatively interfaced with a brush guard useful to help reduce the likelihood of becoming entangled with vegetation and similar environmental hazards. Some embodiments may be configured to permit attachment of a bayonet, light source, heat shield, or other accessory. The diffusor assembly 101 can be configured for other suitable accessories with which suppressor assembly 100 optionally may be interfaced will depend on a given application and will be apparent in light of this disclosure.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A signature-reduction assembly for a firearm, the assembly comprising:

a body with a tubular sidewall extending along a central axis between a proximal end and a distal end, the body including a diffusor portion adjacent the proximal end and a signature-reduction portion adjacent the distal end;

one or more diffusor baffles in the diffusor portion of the body and extending across an inside of the tubular sidewall in a direction transverse to the central axis, each of the one or more diffusor baffles defining a central diffusor opening aligned with the central axis and a plurality of outer diffusor openings positioned radially outside of the central diffusor opening and;

a plurality of signature-reduction baffles having an axially spaced-apart arrangement in the signature-reduction portion and located distally of the one or more diffusor baffles, each of the plurality of signature-reduction baffles extending across an inside of the tubular sidewall in a direction transverse to the central axis and defining (i) a central baffle opening aligned with the central axis and (ii) a baffle port positioned radially outside of the central baffle opening;

wherein the baffle port of each of the plurality of signature-reduction baffles is rotated about the central axis from 185 to 225 degrees with respect to the baffle port of an adjacent one of the plurality of signature-reduction baffles; and wherein the assembly provides a first gas flow path generally along the central axis, and an elongated and less restrictive second gas flow path through the baffle ports of the plurality of signature-reduction baffles.

2. The signature-reduction assembly of claim 1, wherein one of more of the plurality of signature-reduction baffles has a generally planar first baffle portion defining the central baffle opening and the baffle port, and a generally planar second baffle portion positioned opposite the baffle port and extending at an angle from the first baffle portion to the tubular sidewall.

3. The signature-reduction assembly of claim 2, wherein one of more of the plurality of signature-reduction baffles has a beveled entrance surface adjacent the central baffle opening and/or a beveled exit surface adjacent the central baffle opening.

4. The signature-reduction assembly of claim 2, wherein the central baffle opening extends through the signature-reduction baffle at a baffle bore angle from 30 to 60 degrees with respect to the first baffle portion.

5. The signature-reduction assembly of claim 2, wherein one of more of the plurality of signature-reduction baffles has a protrusion on a proximal face of the generally planar first baffle portion, the protrusion at least partially surrounding the central baffle opening and configured to direct propellant gases away from the central baffle opening.

6. The signature-reduction assembly of claim 1, wherein propellant gases following the first gas flow path mix with propellant gasses following the elongated and less restrictive second gas flow path between adjacent ones of the plurality of signature-reduction baffles.

7. The signature-reduction assembly of claim 2, wherein the elongated and less restrictive second gas flow path is a rotating, sinuous flow path through the baffle port of each of the plurality of signature-reduction baffles.

8. The signature-reduction assembly of claim 1, wherein an area of the plurality of outer diffusor openings is at least three times an area of the central diffusor opening.

9. The signature-reduction assembly of claim 8, wherein the area of the plurality of outer diffusor openings is at least ten times the area of the central diffusor opening.

10. The signature-reduction assembly of claim 1, wherein the diffusor assembly provides a combination of flash suppression and sound suppression in a single monolithic unit.

11. The signature-reduction assembly of claim 1 further comprising a suppressor attached to the signature-reduction assembly, the suppressor having a barrel mount and a hollow suppressor body, wherein the suppressor is configured to couple the signature-reduction assembly to a barrel of a host firearm with the central axis of the signature-reduction assembly aligned with a bore axis of the barrel.

12. The signature-reduction assembly of claim 11, wherein an interface between the suppressor and the signature-reduction assembly includes threads and a sealing taper with an included angle between 25° and 60°.

13. A diffusor assembly configured for use with a host firearm having a barrel with a bore extending therethrough along a bore axis, the diffusor assembly comprising:

a body with a tubular sidewall extending along a central axis;

at least one diffusor baffle extending across an inside of the tubular sidewall in a direction transverse to the central axis, wherein the at least one diffusor baffle defines a diffusor central opening aligned with the central axis, and a plurality of outer diffusor openings positioned between the diffusor central opening and the tubular diffusor body; and a plurality of signature-reduction baffles located distally of the at least one diffusor baffle and extending across the inside of the tubular sidewall in a direction transverse to the central axis, each of the plurality of signature-reduction baffles having a first baffle portion having a generally planar proximal face extending generally perpendicularly to the central axis and defining a central baffle opening aligned with the central axis, and a baffle port positioned radially outside of the central baffle opening; and a second baffle portion positioned opposite the baffle port and radially outside of the central baffle opening, the second baffle portion having a generally planar second proximal face defining an angle from 10 to 60 degrees with the proximal face of the first baffle portion, the second baffle portion connected to the first baffle portion and to the tubular sidewall.

14. The diffusor assembly of claim 13, wherein a combined area of the plurality of outer diffusor openings is at least three times an area of the diffusor central opening; and wherein the baffle port has an area that is at least three times an area of the central baffle opening.

15. The diffusor assembly of claim 13, wherein one of more of the plurality of signature-reduction baffles has a beveled entrance surface and/or a beveled exit surface adjacent the central baffle opening.

16. The diffusor assembly of claim 13, wherein one of more of the plurality of signature-reduction baffles has a protrusion on the proximal face of the first baffle portion, the protrusion at least partially surrounding the central baffle opening and configured to direct propellant gases away from the central baffle opening.

17. The diffusor assembly of claim 13 further comprising:

a suppressor having a distal end portion attached to a proximal end portion of the diffusor assembly, the suppressor having a suppressor proximal end portion with a barrel mount attachable to the barrel of the host firearm.

18. The diffusor assembly of claim 17 further comprising a firearm barrel attached to the suppressor via the barrel mount, wherein the suppressor is attached to the diffusor assembly, and wherein discharging the firearm releases propellant gases from the barrel into the suppressor, a minority portion of the propellant gases following a first flow path generally along the central axis through the diffusor assembly, and a majority portion of the propellant gases following a second flow path through the outer diffusor openings and the baffle port of each of the plurality of signature-reduction baffles.

19. The diffusor assembly of claim 13 further comprising:

a suppressor removably attachable to a proximal end portion of the body, the suppressor having a barrel mount and a hollow suppressor body, wherein the suppressor is configured to couple the diffusor assembly to the barrel of the host firearm.

20. The diffusor assembly of claim 19, wherein an interface between the suppressor and the diffusor assembly includes threads and a sealing taper with an included angle between 25° and 60°.

21. A suppressor baffle comprising:

a tubular body extending along a central axis between a first end and a second end; and a baffle connected to and extending across an inside of the tubular body in a direction transverse to the central axis, the baffle having a first baffle portion defining a central baffle opening aligned with the central axis and a baffle port positioned radially between the central baffle opening and the tubular body, the first baffle portion having a generally planar face and extending generally perpendicular to the central axis; and a second baffle portion connected to the first baffle portion radially outside of the central baffle opening and positioned opposite the baffle port, wherein the second baffle portion is generally planar and defines an angle from 10 to 60 degrees with the first baffle portion and extends proximally from the first baffle portion to the tubular sidewall;

wherein an area of the baffle port is at least three times an area of the central baffle opening.

22. The suppressor baffle of claim 21, wherein the central baffle opening extends through the first baffle portion at a baffle bore angle from 30 to 60 degrees with respect to the generally planar face of the first baffle portion.

23. The suppressor baffle of claim 21 further comprising a a protrusion extending from the generally planar face and at least partially surrounding the central baffle opening.

24. The suppressor baffle of claim 21, wherein the baffle port has a shape of a chord of a circle.

* * * * *